US011982275B2

(12) United States Patent
Kim et al.

(10) Patent No.: US 11,982,275 B2
(45) Date of Patent: May 14, 2024

(54) SCROLL COMPRESSOR INCLUDING GROOVED DISCHARGE AND BYPASS VALVE ARRANGEMENT

(71) Applicant: LG ELECTRONICS INC., Seoul (KR)

(72) Inventors: Suchul Kim, Seoul (KR); Sanghyeon Ji, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/113,203

(22) Filed: Feb. 23, 2023

(65) Prior Publication Data

US 2024/0035474 A1 Feb. 1, 2024

(30) Foreign Application Priority Data

Jul. 27, 2022 (KR) ..... 10-2022-0093305

(51) Int. Cl.
*F04C 28/26* (2006.01)
*F04C 18/02* (2006.01)
(Continued)

(52) U.S. Cl.
CPC ..... *F04C 28/26* (2013.01); *F04C 18/0215* (2013.01); *F04C 28/24* (2013.01);
(Continued)

(58) Field of Classification Search
CPC ..... F04C 28/26; F04C 18/0215; F04C 28/24; F04C 29/028; F04C 2240/805; F04C 2270/205
See application file for complete search history.

(56) References Cited

U.S. PATENT DOCUMENTS

2006/0099098 A1* 5/2006 Lee ..... F04C 29/128 418/55.1
2015/0345493 A1 12/2015 Lochner et al.
(Continued)

FOREIGN PATENT DOCUMENTS

JP 2004-197720 7/2004
KR 10-2005-0111062 11/2005
(Continued)

OTHER PUBLICATIONS

Korean Office Action dated Nov. 30, 2023 issued in Application No. 10-2022-0093305.

*Primary Examiner* — Dominick L Plakkoottam
*Assistant Examiner* — Paul W Thiede
(74) *Attorney, Agent, or Firm* — KED & ASSOCIATES

(57) ABSTRACT

A scroll compressor is provided, in which a fastening member fixing portion of a valve fastening member fixes the valve fastening member to a non-orbiting scroll, a valve fixing portion of the valve fastening member fixes a bypass valve to the non-orbiting scroll, and the fastening member fixing portion is located axially farther away from a compression chamber than the valve fixing portion is. This may secure a fastening thickness by which the valve fastening member that fixes the bypass valve is fastened to the non-orbiting scroll and reduce a plate thickness at a portion where bypass holes and/or a discharge port are formed, thereby decreasing dead volumes in the bypass holes and/or the discharge port.

16 Claims, 13 Drawing Sheets

(51) Int. Cl.
*F04C 28/24* (2006.01)
*F04C 29/02* (2006.01)

(52) U.S. Cl.
CPC ..... *F04C 29/028* (2013.01); *F04C 2240/80* (2013.01); *F04C 2240/805* (2013.01); *F04C 2270/205* (2013.01)

(56) References Cited

U.S. PATENT DOCUMENTS

| | | | | |
|---|---|---|---|---|
| 2018/0038370 | A1 | 2/2018 | Doepker et al. | |
| 2019/0219055 | A1* | 7/2019 | Kim | F04C 27/005 |
| 2020/0340476 | A1* | 10/2020 | Park | F04C 18/0215 |
| 2021/0115923 | A1* | 4/2021 | Jo | F04C 29/0057 |

FOREIGN PATENT DOCUMENTS

| | | | | |
|---|---|---|---|---|
| KR | 2006074489 | A * | 7/2006 | F04C 18/0215 |
| KR | 10-2014-0114212 | | 9/2014 | |
| KR | 10-2017-0007374 | | 1/2017 | |
| WO | WO-2021192238 | A1 * | 9/2021 | |

* cited by examiner

SCROLL COMPRESSOR INCLUDING GROOVED DISCHARGE AND BYPASS VALVE ARRANGEMENT

CROSS-REFERENCE TO RELATED APPLICATION(S)

Pursuant to 35 U.S.C. § 119(a), this application claims the benefit of the earlier filing date and the right of priority to Korean Patent Application No. 10-2022-0093305, filed in Korea on Jul. 27, 2022, the contents of which are incorporated by reference herein in their entirety.

BACKGROUND

1. Field

A scroll compressor is disclosed herein.

2. BACKGROUND

A scroll compressor is configured such that an orbiting scroll and a non-orbiting scroll are engaged with each other, and a pair of compression chambers is formed between the orbiting scroll and the non-orbiting scroll while the orbiting scroll performs an orbiting motion with respect to the non-orbiting scroll. Each compression chamber includes a suction pressure chamber formed at an outer side, an intermediate pressure chamber continuously formed toward a central portion from the suction pressure chamber while gradually decreasing in volume, and a discharge pressure chamber connected to a center of the intermediate pressure chamber. Typically, the suction pressure chamber communicates with a refrigerant suction pipe through a side surface of the non-orbiting scroll, the intermediate pressure chamber is sealed and connected in multiple stages, and the discharge pressure chamber communicates with a refrigerant discharge pipe through a center of an end plate of the non-orbiting scroll.

The scroll compressor is configured so that the compression chamber continuously moves, which may cause overcompression during operation. Accordingly, in the related art scroll compressor, a bypass hole is formed around a discharge port, that is, at an upstream side of the discharge port to discharge overcompressed refrigerant in advance. A bypass valve is disposed in the bypass hole to open and close the bypass hole according to pressure in the compression chamber. A plate valve or a reed valve is mainly applied as the bypass valve.

U.S. Patent Publication No. 2018/0038370 (hereinafter "Patent Document 1"), which is hereby incorporated by reference, discloses a scroll compressor to which a bypass valve configured as a plate valve is applied. Patent Document 1 discloses that a single bypass valve in an annular shape opens and closes a plurality of bypass holes, but this increases the number of components as the bypass valve is supported by an elastic member. In addition, as the bypass valve operates in a separated state, it is difficult to modularize the bypass valve, which may increase the number of assembly processes of the compressor. As a length of the bypass hole increases, not only overcompression due to discharge delay occurs, but also a dead volume increases, which may decrease indicated efficiency.

Korean Patent Publication No. 10-2014-0114212 (hereinafter "Patent Document 2"), which is hereby incorporated by reference, and U.S. Patent Publication No. 2015/0345493 (hereinafter "Patent Document 3"), which is hereby incorporated by reference, each discloses a scroll compressor to which a bypass valve configured as a reed valve is applied. In Patent Document 2 and Patent Document 3, the bypass valve is fixed to a non-orbiting scroll using a rivet or pin. For this, an end plate of the non-orbiting scroll should be as thick as a rivet depth or a pin depth, which causes an increase in length of the bypass hole. As a result, as in Patent Document 1, refrigerant discharge through the bypass hole is delayed and thereby the refrigerant is overcompressed. In addition, a dead volume increases due to the increased length of the bypass hole, causing indicated efficiency to be degraded.

BRIEF DESCRIPTION OF THE DRAWINGS

Embodiments will be described in detail with reference to the following drawings in which like reference numerals refer to like elements, and wherein.

DETAILED DESCRIPTION

Figure 1:
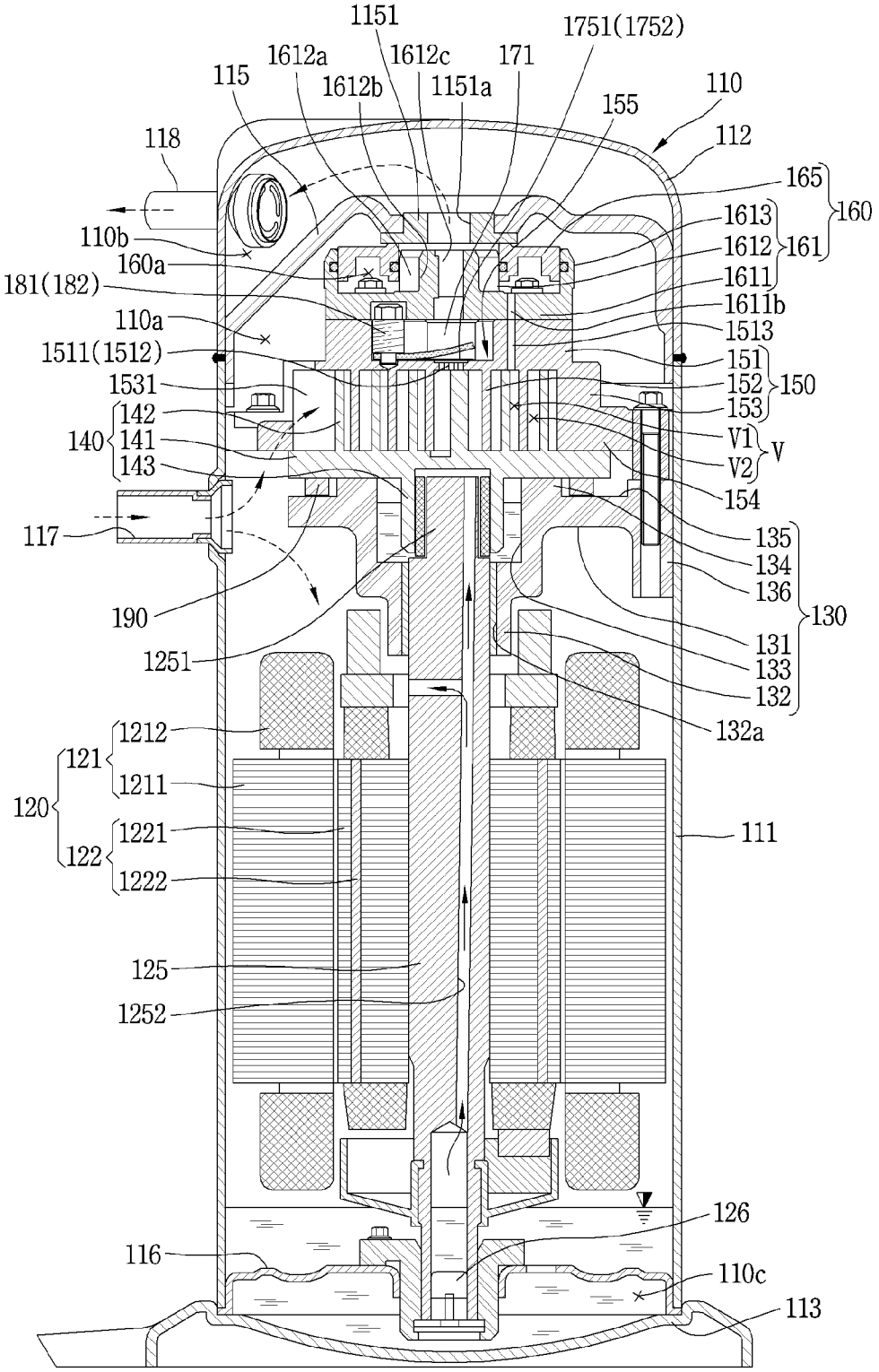
FIG. 1 is a longitudinal cross-sectional view illustrating an inner structure of a capacity-variable scroll compressor in accordance with an embodiment.

Description will now be given of a scroll compressor according to embodiments disclosed herein, with reference to the accompanying drawings.

Typically, a scroll compressor may be classified as an open type or a hermetic type depending on whether a drive (motor) and a compression part or portion are all installed in an inner space of a casing. The former is a compressor in which the motor configuring the drive is provided separately from the compression portion, and the latter hermetic type is a compressor in which both the motor and the compression are disposed inside of the casing. Hereinafter, a hermetic type scroll compressor will be described as an example, but it is not necessarily limited to the hermetic scroll compressor. In other words, embodiments may be equally applied even to the open type scroll compressor in which the motor and the compression portion are disposed separately from each other.

A scroll compressor is also classified as a low-pressure type compressor or a high-pressure type compressor depending on what type of pressure is defined in an inner space of a casing, specifically, a space accommodating the motor in a hermetic scroll compressor. In the former, the space defines a low-pressure part or portion and a refrigerant suction pipe communicates with the space. On the other hand, in the latter, the space defines a high-pressure part or portion and the refrigerant suction pipe is directly connected to the compression portion through the casing. Hereinafter, a low-pressure type scroll compressor according to an embodiment will be described as an example. However, embodiments are not limited to the low-pressure type scroll compressor.

In addition, scroll compressors may be classified into a vertical scroll compressor in which a rotary shaft is disposed perpendicular to the ground and a horizontal (lateral) scroll compressor in which the rotary shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, embodiments may also be equally applied to the horizontal scroll compressor. Hereinafter, it will be understood that an axial direction is an axial direction of the rotary shaft, a radial direction is a radial direction of the rotary shaft, the axial direction is an upward and downward direction, the radial direction is a left and right or lateral direction, and an inner circumferential surface is an upper surface, respectively.

In addition, scroll compressors may be mainly divided into a tip seal type and a back pressure type depending on a method of sealing between compression chambers. The back pressure type may be divided into an orbiting back pressure type of pressing an orbiting scroll toward a non-orbiting scroll, and a non-orbiting back pressure type of pressing the non-orbiting scroll toward the orbiting scroll. Hereinafter, a scroll compressor to which a non-orbiting back pressure type is applied will be described as an example. However, embodiments may also be applied to the tip seal type as well as the orbiting back pressure type.

Figure 2:
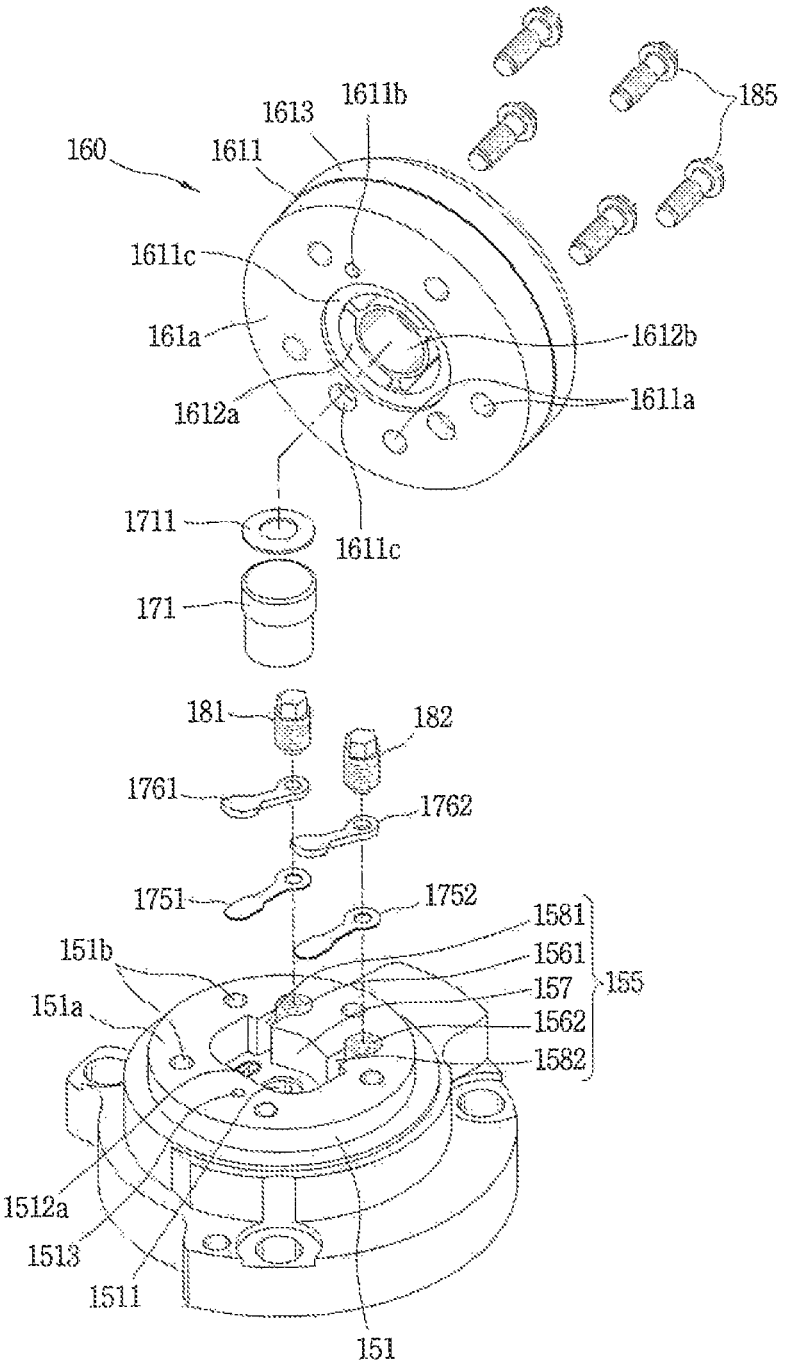
FIG. 2 is an exploded perspective view illustrating a non-orbiting scroll and a back pressure plate in FIG. 1.

FIG. 1 is a longitudinal cross-sectional view illustrating an inner structure of a capacity-variable scroll compressor in accordance with an embodiment. FIG. 2 is an exploded perspective view illustrating a portion of a compression portion in FIG. 1.

A scroll compressor according to an embodiment may include a drive motor 120 constituting a motor disposed in a lower half portion of a casing 110, and a main frame 130, an orbiting scroll 140, a non-orbiting scroll 150, a back pressure chamber assembly 160, and a valve assembly 170 that constitute a compression part or portion disposed above the drive motor 120. The motor is coupled to one (first) end of a rotary shaft 125, and the compression portion is coupled to another (second) end of the rotary shaft 125. Accordingly, the compression portion may be connected to the motor by the rotary shaft 125 to be operated by a rotational force of the motor.

Referring to FIG. 1, the casing 110 according to embodiment may include a cylindrical shell 111, an upper cap 112, and a lower cap 113. The cylindrical shell 111 has a cylindrical shape with upper and lower ends open, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 described hereinafter may be coupled to the upper portion of the cylindrical shell 111, for example, above the drive motor 120.

The upper cap 112 may be coupled to cover an upper opening of the cylindrical shell 111. The lower cap 113 may be coupled to cover a lower opening of the cylindrical shell 111. A rim of a high/low pressure separation plate 115 described hereinafter may be inserted between the cylindrical shell 111 and the upper cap 112 to be, for example, welded on the cylindrical shell 111 and the upper cap 112. A rim of a support bracket 116 described hereinafter may be inserted between the cylindrical shell 111 and the lower cap 113 to be, for example, welded on the cylindrical shell 111 and the lower cap 113. Accordingly, the inner space of the casing 110 may be sealed.

The rim of the high/low pressure separation plate 115 may be welded on the casing 110 as described above. A central portion of the high/low pressure separation plate 115 may be bent and protrude toward an upper surface of the upper cap 112 so as to be disposed above the back pressure chamber assembly 160 described hereinafter. A refrigerant suction pipe 117 communicates with a space below the high/low pressure separation plate 115, and a refrigerant discharge pipe 118 communicates with a space above the high/low pressure separation plate 115. Accordingly, a low-pressure part or portion 110*a* constituting a suction space may be formed below the high/low pressure separation plate 115, and a high-pressure part or portion 110*b* constituting a discharge space may be formed above the high/low pressure separation plate 115.

In addition, a through hole 115*a* may be formed through a center of the high/low pressure separation plate 115. A sealing plate 1151 from which a floating plate 165 described hereinafter is detachable may be inserted into the through hole 115*a*. The low-pressure portion 110*a* and the high-pressure portion 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 may define an oil storage space 110*c* together with the lower portion of the cylindrical shell 111 constituting the low-pressure portion 110*a*. In other words, the oil storage space 110*c* is defined in the lower portion of the low-pressure portion 110*a*. The oil storage space 110*c* thus defines a portion of the low-pressure portion 110*a*.

Referring to FIG. 1, the drive motor 120 according to an embodiment is disposed in a lower half portion of the low-pressure portion 110*a* and may include a stator 121 and a rotor 122. The stator 121 may be, for example, shrink-fitted to an inner wall surface of the casing 111, and the rotor 122 may be rotatably provided inside of the stator 121. The stator 121 may include a stator core 1211 and a stator coil 1212.

The stator core 1211 may be formed in a cylindrical shape and may be shrink-fitted onto an inner circumferential surface of the cylindrical shell 111. The stator coil 1212 may be wound around the stator core 1211 and may be electrically connected to an external power source through a terminal (not illustrated) that is coupled through the casing 110.

The rotor 122 may include a rotor core 1221 and permanent magnets 1222. The rotor core 1221 may be formed in a cylindrical shape, and be rotatably inserted into the stator core 1211 with a preset or predetermined gap therebetween.

The permanent magnets 1222 may be embedded in the rotor core 1222 at preset or predetermined intervals along a circumferential direction.

In addition, the rotary shaft 125 may be press-fitted to a center of the rotor core 1221. An orbiting scroll 140 described hereinafter may be eccentrically coupled to an upper end of the rotary shaft 125. Accordingly, the rotational force of the drive motor 120 may be transmitted to the orbiting scroll 140 through the rotary shaft 125.

An eccentric portion 1251 that is eccentrically coupled to the orbiting scroll 140 described hereinafter may be formed on an upper end of the rotary shaft 125. An oil pickup 126 that suctions up oil stored in the lower portion of the casing 110 may be disposed in or at a lower end of the rotary shaft 125. An oil passage 1252 may be formed through an inside of the rotary shaft 125 in the axial direction.

Referring to FIG. 1, the main frame 130 may be disposed on an upper side of the drive motor 120, and may be, for example, shrink-fitted to or welded on an inner wall surface of the cylindrical shell 111. The main frame 130 may include a main flange portion (main flange) 131, a main bearing portion (main bearing) 132, an orbiting space portion (orbiting space) 133, a scroll support portion (scroll support) 134, an Oldham ring support portion (Oldham ring support) 135, and a frame fixing portion 136.

The main flange portion 131 may be formed in an annular shape and accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 described hereinafter may protrude from an outer circumferential surface of the main flange portion 131 in the radial direction. An outer circumferential surface of the frame fixing portion 136 may be fixed in close contact with the inner circumferential surface of the casing 110. Accordingly, the main frame 130 may be fixedly coupled to the casing 110.

The main bearing portion 132 may protrude downward from a lower surface of a central part or portion of the main flange portion 131 toward the drive motor 120. A bearing hole 132*a* formed in a cylindrical shape may penetrate through the main bearing portion 132 in the axial direction. The rotary shaft 125 may be inserted into an inner circumferential surface of the bearing hole 132*a* and supported in the radial direction.

The orbiting space portion 133 may be recessed from the center portion of the main flange portion 131 toward the main bearing portion 132 to have a predetermined depth and outer diameter. The outer diameter of the orbiting space portion 133 may be larger than an outer diameter of a rotary shaft coupling portion 143 that is disposed on the orbiting scroll 140 described hereinafter. Accordingly, the rotary shaft coupling portion 143 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support the lower surface of an orbiting end plate 141 described hereinafter in the axial direction.

The Oldham ring support portion 135 may be formed in an annular shape on an upper surface of the main flange portion 131 along an outer circumferential surface of the scroll support portion 134. Accordingly, an Oldham ring 190 may be inserted into the Oldham ring supporting portion 135 to be pivotable.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 includes a plurality of protrusions along the circumferential direction.

Referring to FIG. 1, the orbiting scroll 140 according to an embodiment is coupled to the rotary shaft 125 to be disposed between the main frame 130 and the non-orbiting scroll 150. The Oldham ring 190, which is an anti-rotation mechanism, is disposed between the main frame 130 and the orbiting scroll 140. Accordingly, the orbiting scroll 140 performs an orbiting motion relative to the non-orbiting scroll 150 while its rotational motion is restricted.

The orbiting scroll 140 may include orbiting end plate 141, an orbiting wrap 142, and rotary shaft coupling portion 143. The orbiting end plate 141 is formed approximately in a disk shape. An outer diameter of the orbiting end plate 141 may be mounted on the scroll support portion 134 of the main frame 130 to be supported in the axial direction. Accordingly, the orbiting end plate 141 and the scroll support portion 134 facing it defines an axial bearing surface (no reference numeral given).

The orbiting wrap 142 is formed in a spiral shape by protruding from an upper surface of the orbiting end plate 141 facing the non-orbiting scroll 150 to a preset or predetermined height. The orbiting wrap 142 is formed to correspond to the non-orbiting wrap 152 to perform an orbiting motion by being engaged with a non-orbiting wrap 152 of the non-orbiting scroll 150 described hereinafter. The orbiting wrap 142 defines compression chambers V together with the non-orbiting wrap 152.

The compression chambers V may include first compression chamber V1 and second compression chamber V2 based on the orbiting wrap 142. Each of the first compression chamber V1 and the second compression chamber V2 may include a suction pressure chamber (not illustrated), an intermediate pressure chamber (not illustrated), and a discharge pressure chamber (not illustrated) that are continuously formed. Hereinafter, description will be given under the assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

The rotary shaft coupling portion 143 may protrude from a lower surface of the orbiting end plate 141 toward the main frame 130. The rotary shaft coupling portion 143 may be formed in a cylindrical shape, so that an orbiting bearing (not illustrated) configured as a bush bearing may be press-fitted thereto.

Referring to FIGS. 1 and 2, the non-orbiting scroll 150 according to an embodiment may be disposed on an upper portion of the main frame 130 with the orbiting scroll 140 interposed therebetween. The non-orbiting scroll 150 may be fixedly coupled to the main frame 130 or may be coupled to the main frame 130 to be movable up and down. This embodiment illustrates an example in which the non-orbiting scroll 150 is coupled to the main frame 130 to be movable relative to the main frame 130 in the axial direction.

The non-orbiting scroll 150 according to this embodiment may include a non-orbiting end plate 151, non-orbiting wrap 152, a non-orbiting side wall portion (non-orbiting side wall) 153, and a guide protrusion 154. The non-orbiting end plate 151 may be formed in a disk shape and disposed in the lateral direction in the low-pressure portion 110*a* of the casing 110. A plurality of back pressure fastening grooves 151*b* may be formed along an edge of the non-orbiting end plate 151. Accordingly, fastening bolts 177 that pass through back pressure fastening holes 1611*a* of a back pressure plate 161 described hereinafter may be fastened to the back pressure fastening grooves 151*b* of the non-orbiting end plate 151, such that the back pressure plate 161 may be fastened to a rear surface (upper surface) 151*a* of the non-orbiting end plate 151.

A discharge port 1511, bypass holes 1512, and a first back pressure hole 1513 may be formed through a central portion of the non-orbiting end plate 151 in the axial direction. The discharge port 1511 may be disposed at a center of the non-orbiting end plate 151, the bypass holes 1512 may be located at an outer side, that is, an upstream side, of the discharge port 1511, and the first back pressure hole 1513 may be located at an outer side, that is, an upstream side, of the bypass hole 1512.

The discharge port 1511 may be located at a position of which a discharge pressure chamber (no reference numeral given) of the first compression chamber V1 and a discharge pressure chamber (no reference numeral given) of the second compression chamber V2 communicate with each other. Accordingly, refrigerant compressed in the first compression chamber V1 and refrigerant compressed in the second compression chamber V2 may be combined in the discharge pressure chamber and discharged to the high-pressure portion 110*b* as a discharge space through the discharge port 1511.

The bypass holes 1512 may include first bypass hole 1512*a* and second bypass hole 1512*b*. Each of the first bypass hole 1512*a* and the second bypass hole 1512*b* may be provided as a single hole or may be provided as a plurality. This embodiment illustrates an example in which each of the first bypass hole 1512*a* and the second bypass hole 1512*b* is provided as a plurality. Accordingly, the bypass holes may be formed to be smaller than a wrap thickness of the orbiting wrap 142 and also an entire area of the bypass holes 1512 may be enlarged.

The first bypass hole 1512*a* may communicate with the first compression chamber V1 and the second bypass hole 1512*b* may communicate with the second compression chamber V2. The first bypass hole 1512*a* and the second bypass hole 1512*b* may be formed at both sides of the discharge port 1511 in the circumferential direction with the discharge port 1511 located at the center, in other words, formed at a suction side rather than the discharge port 1511. Accordingly, when refrigerant is overcompressed in each of the compression chambers V1 and V2, the refrigerant may be bypassed in advance before reaching the discharge port 1511, thereby suppressing or preventing the overcompression.

Both the first bypass hole 1512*a* and the second bypass hole 1512*b* may be accommodated in a valve opening/closing groove 157, which will be described hereinafter, together with the discharge port 1511. In other words, the valve opening/closing groove 157 described hereinafter is recessed by a preset or predetermined depth into the rear surface 151*a* of the non-orbiting end plate 151, and the first bypass hole 1512*a* and the second bypass hole 1512*b* are formed inside of the valve opening/closing groove 157 together with the discharge port 1511. Accordingly, each axial length L2 of the first bypass hole 1512*a* and the second bypass hole 1512*b* inside of the valve opening/closing groove 157 may be shortened by a value that is obtained by subtracting an axial depth D1 of the valve opening/closing groove 157 from a plate thickness (hereinafter, first plate thickness) T1 of the non-orbiting end plate 151, which may result in decreasing dead volumes in the first bypass hole 1512*a* and the second bypass hole 1512*b*. This advantage may also be expected in the discharge port 1511. The valve opening/closing groove 157 will be described hereinafter together with valve fixing grooves 1561 and 1562.

The first back pressure hole 1513 may be formed through the non-orbiting end plate 151 in the axial direction, so as to communicate with a compression chamber V that forms an intermediate pressure between a suction pressure and a discharge pressure. The first back pressure hole 1513 may be provided as one to communicate with any one of the first compression chamber V1 or the second compression chamber V2, or may be provided as a plurality to communicate with both of the first and second compression chambers V1 and V2, respectively.

The non-orbiting wrap 152 may extend axially from a lower surface of the non-orbiting end plate 151. The non-orbiting wrap 152 may be formed in a spiral shape inside of the non-orbiting side wall portion 153 to correspond to the orbiting wrap 142 so as to be engaged with the orbiting wrap 142.

The non-orbiting side wall portion 153 may extend in an annular shape from a rim of a lower surface of the non-orbiting end plate 151 in the axial direction to surround the non-orbiting wrap 152. A suction port 1531 may be formed through one side of an outer circumferential surface of the non-orbiting side wall portion 153 in the radial direction. Accordingly, each of the first compression chamber V1 and the second compression chamber V2 compresses suctioned refrigerant as its volume decreases from an outer side to a center.

The guide protrusion 154 may extend radially from an outer circumferential surface of a lower side of the non-orbiting side wall portion 153. The guide protrusion 154 may be formed as a single annular shape or may be provided as a plurality disposed at preset or predetermined distances in the circumferential direction. This embodiment will be mainly described based on an example in which a plurality of guide protrusions 154 is disposed at preset or predetermined distances along the circumferential direction.

Referring to FIG. 1, the back pressure chamber assembly 160 according to an embodiment may be disposed at an upper side of the non-orbiting scroll 150. Accordingly, back pressure of a back pressure chamber 160*a* (to be precise, a force that the back pressure applies to the back pressure chamber) is applied to the non-orbiting scroll 150. In other words, the non-orbiting scroll 150 is pressed toward the orbiting scroll 140 by the back pressure to seal the compression chambers V1 and V2.

The back pressure chamber assembly 160 may include back pressure plate 161 and floating plate 165. The back pressure plate 161 may be coupled to an upper surface of the non-orbiting end plate 151. The floating plate 165 may be slidably coupled to the back pressure plate 161 to define the back pressure chamber 160*a* together with the back pressure plate 161.

The back pressure plate 161 may include a fixed plate portion (fixed plate) 1611, a first annular wall portion (first annular wall) 1612, and a second annular wall portion (second annular wall) 1613. The fixed plate portion 1611 may be in the form of an annular plate with a hollow center. A plurality of back pressure fastening holes 1611*a* may be formed along an edge of the fixed plate portion 1611. Accordingly, the fixed plate portion 1611 may be fastened to the non-orbiting scroll 150 by the fastening bolts 177 inserted through the back pressure fastening holes 1611*a*.

A plate-side back pressure hole (hereinafter, referred to as a "second back pressure hole") 1611*b* may be formed through the fixed plate portion 1611 in the axial direction. The second back pressure hole 1611*a* may communicate with the compression chamber V through the first back pressure hole 1513. Accordingly, the compression chamber V and the back pressure chamber 160*a* may communicate with each other through the second back pressure hole 1611*a* as well as the first back pressure hole 1513.

The first annular wall portion 1612 and the second annular wall portion 1613 may be formed on an upper surface of the fixed plate portion 1611 to surround inner and outer circumferential surfaces of the fixed plate portion 1611. Accordingly, the back pressure chamber 160*a* formed in the annular shape may be defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may include an intermediate discharge port 1612*a* that communicates with the discharge port 1511 of the non-orbiting scroll 150. A valve guide groove 1612*b* into which a discharge valve 171 may be slidably inserted may be formed at an inner side of the intermediate discharge port 1612*a*. A backflow prevention hole 1612*c* may be formed in a center of the valve guide groove 1612*b*. Accordingly, the discharge valve 171 may be selectively opened and closed between the discharge port 1511 and the intermediate discharge port 1612*a* to suppress or prevent discharged refrigerant from flowing back into the compression chambers V1 and V2.

The floating plate 165 may be formed in an annular shape. The floating plate 165 may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on the pressure of the back pressure chamber 160*a*. For example, when the floating plate 165 is brought into contact with the high/low pressure separation plate 115, the floating plate 165 serves to seal the low-pressure portion 110*a* such that the discharged refrigerant is discharged to the high-pressure portion 110*b* without leaking into the low-pressure portion 110*a*.

Discharge valve 171 and bypass valves 1751 and 1752 may be disposed between the non-orbiting scroll 150 and the back pressure chamber assembly 160, to open and close the discharge port 1511 and the bypass hole 1512*a* and 1512*b*. The discharge valve 171 may be a piston valve and the bypass valves 1751 and 1752 may be reed valves. However, in some cases, the discharge valve 171 as well as the bypass valves may also be configured as the reed valve. Hereinafter, a case in which the discharge valve 171 is a piston valve will be described first, and another case in which the discharge valve 171 is a reed valve will be described hereinafter with respect to another embodiment.

Figure 3:
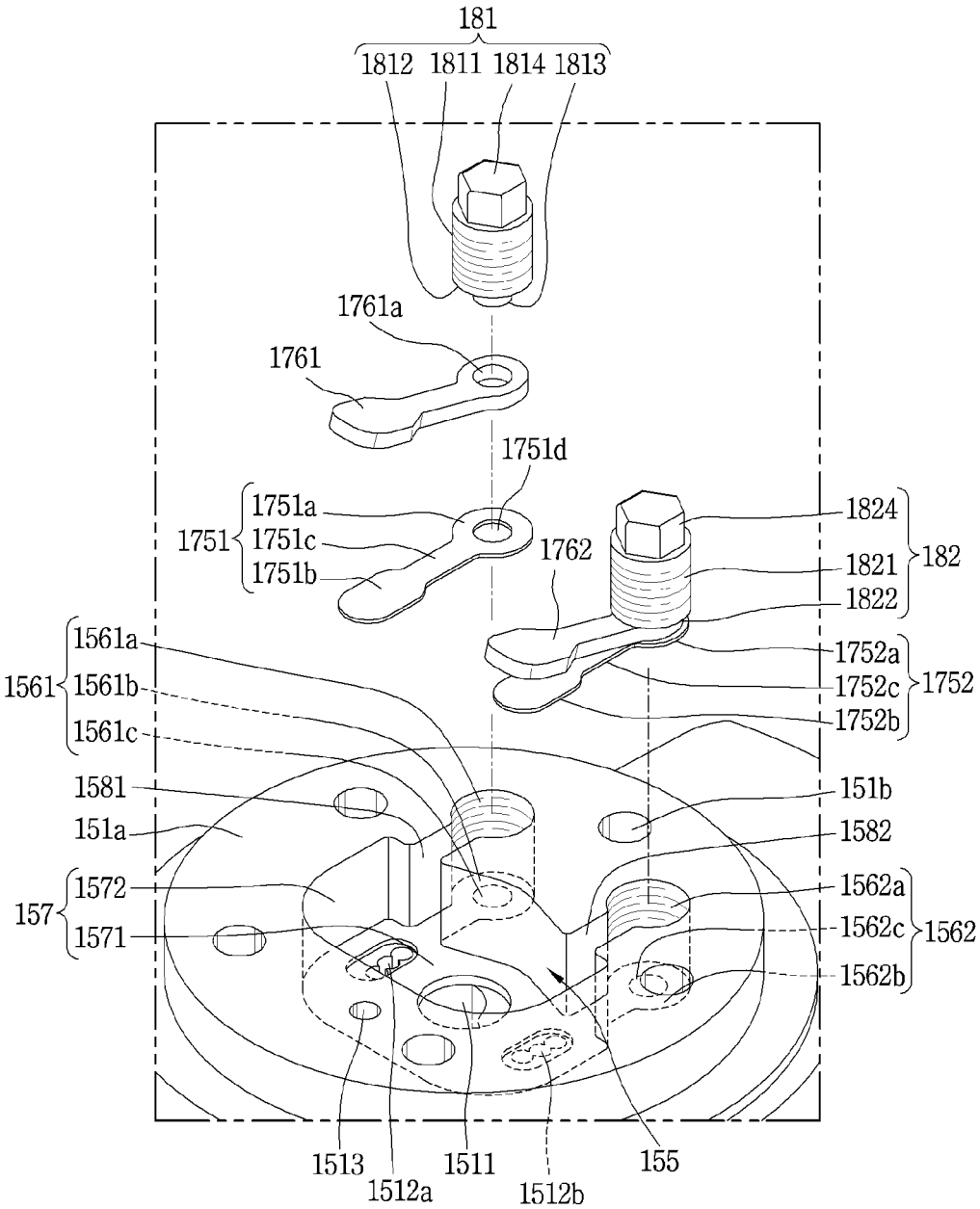
FIG. 3 is a perspective view illustrating bypass valves exploded from the non-orbiting scroll in FIG. 2.
Figure 4:
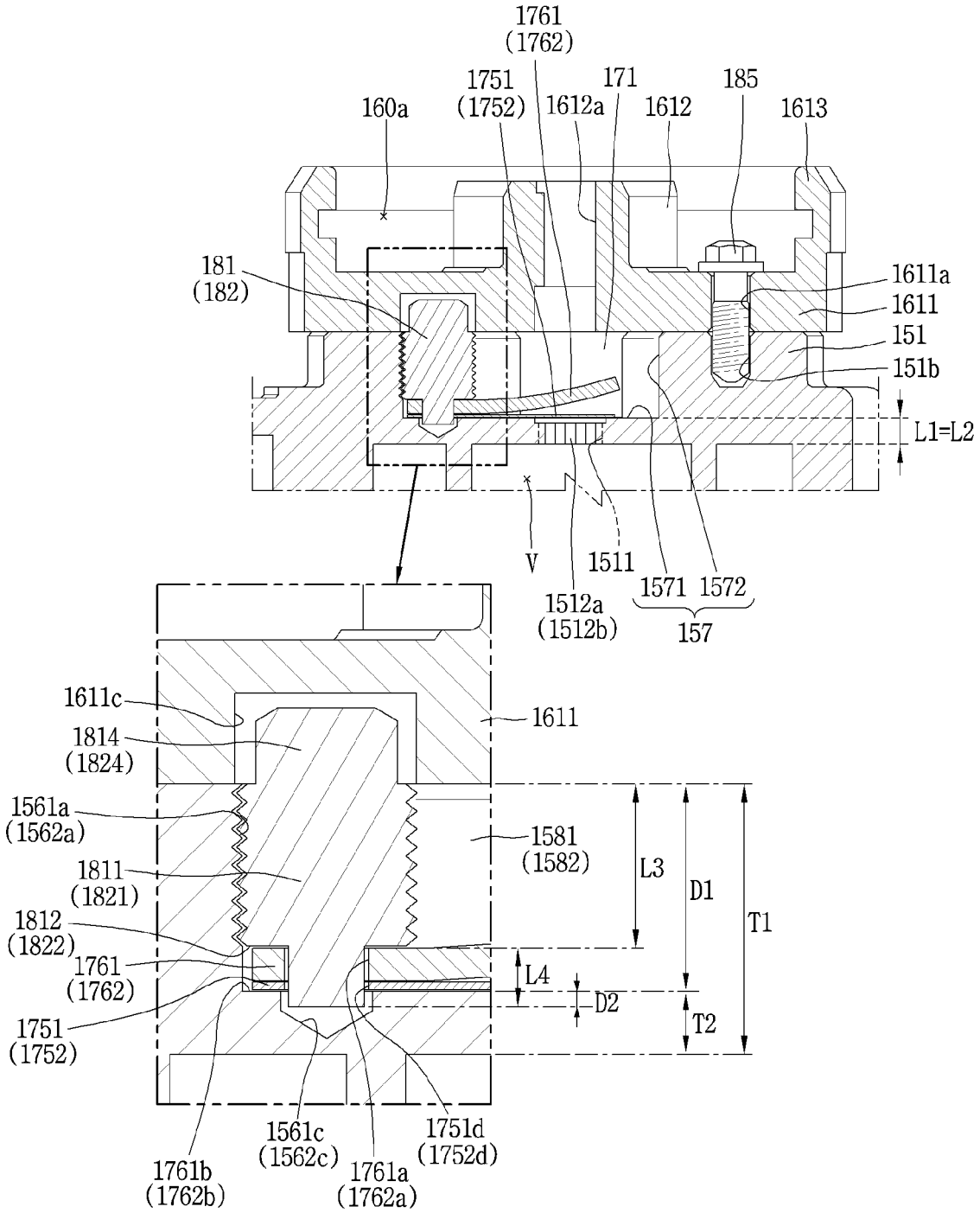
FIG. 4 is a cross-sectional view illustrating a state in which the bypass valves are assembled with the non-orbiting scroll in FIG. 2.
Figure 5:
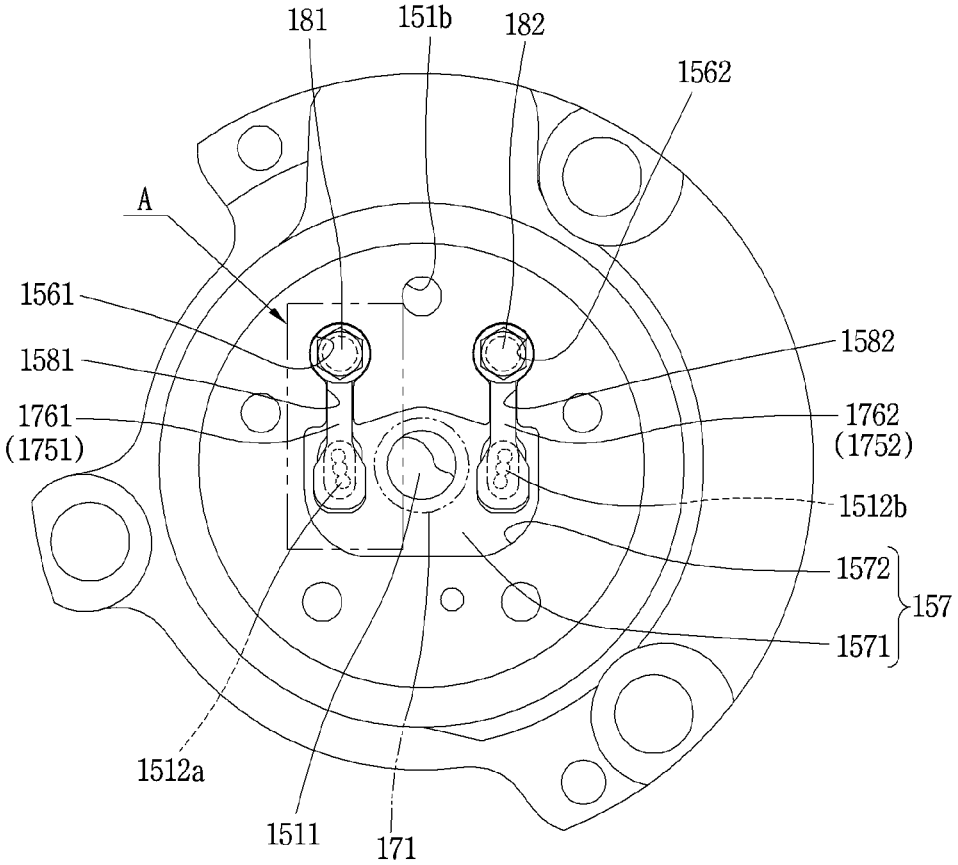
FIG. 5 is a planar view illustrating the state in which the bypass valves are assembled with the non-orbiting scroll in FIG. 2.
Figure 6:
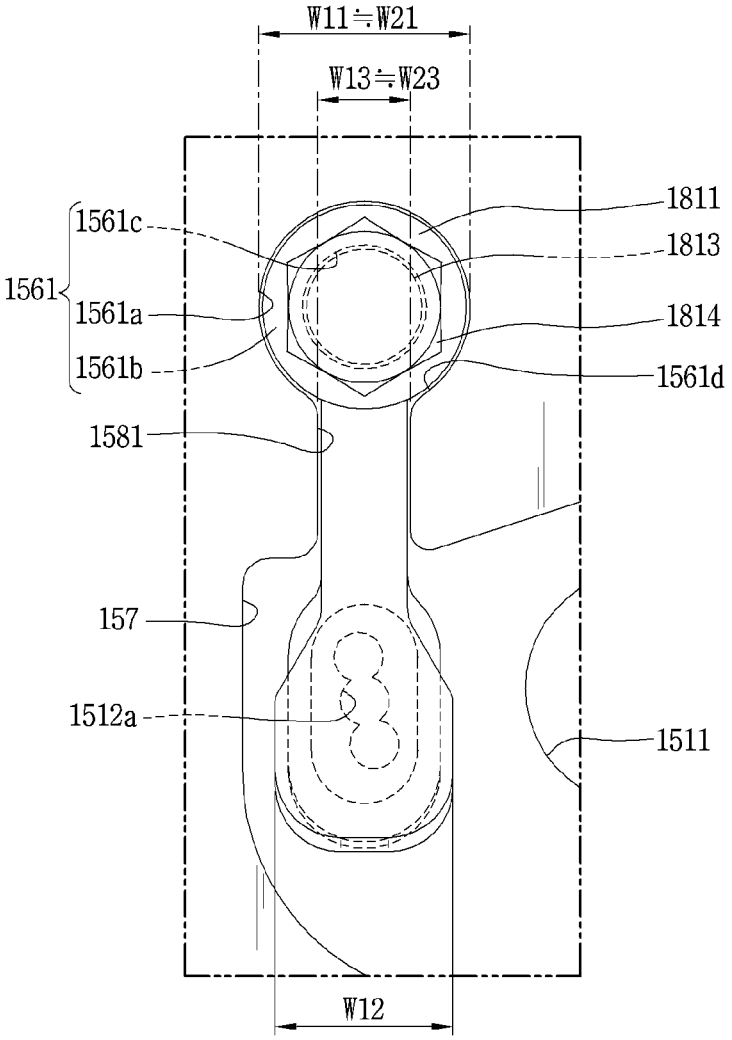
FIG. 6 is an enlarged planar view illustrating a portion "A" of FIG. 5.

FIG. 3 is a perspective view illustrating bypass valves exploded from the non-orbiting scroll in FIG. 2. FIG. 4 is a cross-sectional view illustrating a state in which the bypass valves are assembled with the non-orbiting scroll in FIG. 2. FIG. 5 is a planar view illustrating the state in which the bypass valves are assembled with the non-orbiting scroll in FIG. 2. FIG. 6 is an enlarged planar view illustrating a portion "A" of FIG. 5.

A valve accommodating groove 155 may be recessed by a preset or predetermined depth into the rear surface 151*a* of the non-orbiting scroll 150 according to an embodiment in a direction toward the compression chamber V. The bypass valves 1751 and 1752 may be inserted into a portion of the valve accommodating groove 155, and the bypass holes 1512*a* and 1512*b* formed in another portion of the valve accommodating groove 155 to be open and closed by the bypass valves 1751 and 1752. Accordingly, axial length L2 of each of the bypass holes 1512*a* and 1512*b* may be shortened while the bypass valves 1751 and 1752 are fastened to the non-orbiting scroll 150, such that dead volumes in the bypass holes 1512*a* and 1512*b* may decrease.

More specifically, referring to FIGS. 3 to 5, the valve accommodating groove 155 according to this embodiment may include valve fixing grooves 1561 and 1562, valve opening/closing groove 157, and valve support grooves 1581 and 1582. The valve fixing grooves 1561 and 1562 are spaces in which fixing portions 1751*a* and 1752*a* of the bypass valves 1751 and 1752 described hereinafter are fixedly inserted, the valve opening/closing groove 157 is a space in which opening/closing portions 1751*b* and 1752*b* of the bypass valves 1751 and 1752 (as well as the discharge valve) are accommodated, and the valve support grooves 1581 and 1582 are spaces in which elastic portions 1751*c* and 1752*c* of the bypass valves 1751 and 1752 described hereinafter are accommodated. Accordingly, the valve fixing grooves 1561 and 1562 and the valve support grooves 1581 and 1582 may be referred to as first valve fixing groove 1561 and first valve support groove 1581, in which the first fixing portion 1751*a* and the first elastic portion 1751*c* of the first bypass valve 1751 described hereinafter are inserted, and second valve fixing groove 1562 and second valve support groove 1582, in which the second fixing portion 1752*a* and the second elastic portion 1752*c* of the second bypass valve 1752 described hereinafter are inserted, respectively. In addition, the valve opening/closing groove 157 may be configured as a single groove in which the first opening/closing portion 1751*b* of the first bypass valve 1751 and the second opening/closing portion 1752*b* of the second bypass valve 1752 (as well as the discharge valve) are accommodated together.

The first valve fixing groove 1561 may be formed symmetrically with the second valve fixing groove 1562, and the first valve support groove 1581 may be formed symmetrically with the second valve support groove 1582. Therefore, hereinafter, the first valve fixing groove 1561 and the first valve support groove 1581 will be mainly described, and the second valve fixing groove 1562 and the second valve support groove 1582 will be understood by the description of the first valve fixing groove 1561 and the first valve support groove 1581.

Referring to FIGS. 3 and 4, the first valve fixing groove 1561 according to this embodiment may include a first fastening member fixing surface 1561*a* and a first valve support surface 1561*b*. The first fastening member fixing surface 1561*a* is a portion to which a first fastening member fixing portion 1811 of the first valve fastening member 181 described hereinafter is fixed, and the first valve support surface 1561*b* is a portion by which the first fixing portion 1751*a* of the first bypass valve 1751 is axially supported. Accordingly, the first fastening member fixing surface 1561*a* may have a circular cross-sectional shape, and the first valve support surface 1561*b* may be formed flat.

The first fastening member fixing surface 1561*a* may be disposed on an inner circumferential surface of the first valve fixing groove 1561. For example, as the first valve fixing groove 1561 is recessed by the preset depth into the rear surface 151*a* of the non-orbiting end plate 151 (or the non-orbiting scroll), an axial depth D1 of the first fastening member fixing surface 1561*a* may be the same as an axial depth D1 of the first valve fixing groove 1561. Accordingly, the first fastening member fixing surface 1561*a* may be located at a position closer to the back pressure chamber assembly 160 than the first valve support surface 1561*b*, that is, farther from the compression chamber V than the first valve support surface 1561*b*.

The first fastening member fixing surface 1561*a* may be configured as a screw thread or a smooth tube, for example, depending on a type of the first valve fastening member 181 described hereinafter. For example, when the first valve fastening member 181 is a bolt (or screw), the first fastening member fixing surface 1561*a* may be configured as a screw thread. On the other hand, when the first valve fastening member 181 is a rivet, the first fastening member fixing surface 1561*a* may be configured as a smooth tube. This embodiment illustrates an example in which the first fastening member 181 is a bolt. Accordingly, the first fastening member fixing surface 1561*a* may be configured as a first screw thread.

As described above, when the first valve support surface 1561*b* is formed as a flat surface, a first protrusion accommodating groove 1561*c* may be formed in a center thereof. The first protrusion accommodating groove 1561*c* may be formed on a same axis as a first valve support hole 1751*d* and a first retainer support hole 1761*a*, which will be described hereinafter. Accordingly, a first valve support protrusion 1813 of a first valve fastening member 181 described hereinafter may be inserted into the first protrusion accommodating groove 1561*c* sequentially through the first retainer support hole 1761*a* and the first valve support hole 1751*d*.

An axial depth D2 of the first protrusion accommodating groove 1561*c* may be smaller than an axial length of the first fastening member fixing surface 1561*a*. In other words, the axial depth D1 of the first fastening member fixing surface 1561*a* may be significantly deeper than the axial depth D2 of the first protrusion accommodating groove 1561*c*. Accordingly, the first valve fastening member 181 described hereinafter may be stably fastened to the non-orbiting scroll 150, and additionally, the first valve support protrusion 1813 of the first valve fastening member 181 may stably support the first bypass valve 1751 as well as a first retainer 1761.

On the other hand, the second valve fixing groove 1562 may include a second fastening member fixing surface 1562*a* and a second valve support surface 1562*b*, and a second protrusion accommodating groove 1562*c* may be formed in the second valve support surface 1562*b*. The second fastening member fixing surface 1562*a* may correspond to the first fastening member fixing surface 1561*a*, the second valve support surface 1562*b* may correspond to the first valve support surface 1561*b*, and the second protrusion accommodating groove 1562*c* may correspond to the first protrusion accommodating groove 1561*c*. Therefore, the second fastening member fixing surface 1562*a*, the second valve support surface 1562*b*, and the second protrusion accommodating groove 1562*c* will be understood by the description of the first fastening member fixing surface 1561*a*, the first valve support surface 1561*b*, and the first protrusion accommodating groove 1561*c*.

Referring to FIGS. 3 and 5, the valve opening/closing groove 157 according to this embodiment may be single as described above. In other words, the valve opening/closing groove 157 may be formed to have an area that is large enough to accommodate both the first opening/closing portion 1751*b* of the first bypass valve 1751 and the second opening/closing portion 1752*b* of the second bypass valve 1752 (as well as the discharge valve). In this embodiment, the valve opening/closing groove 157 may be formed in a substantially rectangular cross-sectional shape. The discharge port 1511 may be formed in a center of the valve opening/closing groove 157 and the first bypass hole 1512*a* and the second bypass hole may be formed at both sides of the discharge port 1511.

The valve opening/closing groove 157 may be recessed by approximately a same depth as the first valve fixing groove 1561 (and the second valve fixing groove). Accordingly, the first fixing portion 1751*a* of the first bypass valve 1751 that is fixed in the first valve fixing groove 1561 (and the second valve fixing groove) may be disposed on one straight line with the first opening/closing portion 1751*b* of the first bypass valve 1751 accommodated in the valve opening/closing groove 157, such that a behavior of the first bypass valve 1751 may be stabilized.

That is, the valve opening/closing groove 157 may include a valve seating surface 1571 and a valve accommodating surface 1572. The valve seating surface 1571 may define a bottom surface where the first opening/closing portion 1751*b* of the first bypass valve 1751 and the second opening/closing portion 1752*b* of the second bypass valve 1752 as well as the discharge valve 171 are seated. The valve accommodating surface 1572 defines a side surface that surrounds the valve seating surface 1571.

The valve seating surface 1571 may be formed flat, and the discharge port 1511 and the bypass holes 1512*a* and 1512*b* may be, respectively, formed through the valve seating surface 1551. In other words, the discharge port 1511 and the bypass holes 1512*a* and 1512*b* may be formed through the valve seating surface 1571 in the axial direction. Accordingly, the discharge port 1511 and the bypass holes 1512*a* and 1512*b* may be located inside of the valve accommodating surface 1572 constituting the valve opening/closing groove 157.

The valve accommodating surface 1572 may be orthogonal to the valve seating surface 1571. In other words, the valve accommodating surface 1572 may be recessed orthogonally from the rear surface 151*a* of the non-orbiting end plate 151 toward the compression chamber V. Accordingly, the valve accommodating surface 1572 may be formed in a direction perpendicular to the valve seating surface 1571 and the rear surface 151*a* of the non-orbiting end plate 151.

Although not illustrated in the drawings, the valve accommodating surface 1572 may be inclined or curved. For example, the valve accommodating surface 1572 may be inclined or curved so that its cross-sectional area is enlarged toward the back pressure chamber assembly 160. Accordingly, flow resistance on the valve accommodating surface 1572 may be reduced so that refrigerant discharged through the discharge port 1511 and/or the bypass holes 1512*a* and 1512*b* may smoothly move toward the intermediate discharge port 1612*a* of the back pressure chamber assembly 160 along the valve accommodating surface 1572.

In addition, although not illustrated in the drawings, a plurality of the valve opening/closing groove 157 may be provided similar to the valve fixing grooves 1561 and 1562 and the valve support grooves 1581 and 1582. For example, the valve opening/closing grooves 157 may include a first valve opening/closing groove (not illustrated) that accommodates only the first opening/closing portion 1751*b* of the first bypass valve 1751, and a second valve opening/closing groove (not illustrated) that accommodates only the second opening/closing portion 1752*b* of the second bypass valve 1752. Even in this case, the first valve opening/closing groove (not illustrated) and the second valve opening/closing groove (not illustrated) may be recessed in the axial direction like the valve fixing grooves 1561 and 1562 and the valve support grooves 1581 and 1582. Then, axial length L2 of each of the first bypass hole 1512*a* and the second bypass hole 1512*b* may be smaller than a plate thickness of the non-orbiting end plate 151 at the outside of the first valve opening/closing groove and/or the second valve opening/closing groove. This may decrease dead volumes in the first bypass hole 1512*a* and the second bypass hole 1512*b*. Of course, even in this case, a discharge valve opening/closing groove (not illustrated) that accommodates the discharge valve 171 may be disposed between the first valve opening/closing groove (not illustrated) and the second valve opening/closing groove (not illustrated), to be separated from or communicate with the first valve opening/closing groove and the second valve opening/closing groove, thereby decreasing the dead volume in the discharge port 1511.

Referring to FIGS. 3 and 6, the first valve support groove 1581 according to an embodiment is disposed between the first valve fixing groove 1561 and the valve opening/closing groove 157, and a cross-sectional area of the valve opening/closing groove 157 is smaller than a cross-sectional area of the first valve fixing groove 1561. Accordingly, a stepped surface 1561*d* that forms a kind of stopping jaw may be formed between the first valve fixing groove 1561 and the first valve support groove 1581, such that the first fixing portion 1751*a* of the first bypass valve 1751 may be caught on the stepped surface 1561*d* so as to be supported in a radial direction (longitudinal direction).

For example, a width W23 of the first valve support groove 1581 may be slightly larger than a width W13 of the first elastic portion 1751*c* of the first bypass valve 1751 but smaller than a width (no reference numeral) of the first fixing portion 1751*a* and/or a width W12 of the first opening/closing portion 1751*b*. Accordingly, the first elastic portion 1751*c* of the first bypass valve 1751, which will be described hereinafter, may be inserted into the first valve support groove 1581 and supported in the radial direction (width direction).

The second valve support groove 1582 may be formed to correspond to the first valve support groove 1581. Therefore, description of the second valve support groove 1582 is the same as the description of the first valve support groove 1581, and repetitive disclosure has been omitted.

Referring to FIGS. 1 and 4, the discharge valve 171 axially slides into the valve guide groove 1612*b*, which is disposed in the back pressure plate 161, to open and close the discharge port 1511. As the discharge valve 171 is inserted into the valve opening/closing groove 157 described hereinafter to open and close the discharge port 1511, the axial length L1 of the discharge port 1511 is shortened and the dead volume in the discharge port 1511 decreases.

The discharge valve 171 may be formed in a shape of a rod or cylinder. In other words, the discharge valve 171 may be formed in a solid rod shape or a hollow cylindrical shape. The discharge valve 171 of this embodiment may be formed in a semi-circular rod or semi-cylindrical shape with a closed upper end and an open lower end. This may reduce a weight of the discharge valve 171 and simultaneously prevent oil in the high-pressure portion 110*b*, which is a discharge space, from stagnating inside of the discharge valve 171.

Although not illustrated, the discharge valve 171 may alternatively be formed in a semi-circular rod or semi-cylindrical shape with an open upper end and a closed lower end. This may reduce a weight of the discharge valve 171 and also allow an opening/closing surface (no reference numeral) of the discharge valve 171 to be close to the discharge port 1511, thereby decreasing the dead volume in the discharge port 1511. However, in this case, an oil drainage hole (not illustrated) that penetrates through between inner and outer circumferential surfaces of the discharge valve 171 may be formed near the opening/closing surface of the discharge valve 171, so as to suppress or prevent stagnation of oil in the discharge valve 171.

Referring to FIGS. 3 and 4, the bypass valves 1755 may include first bypass valve 1751 and second bypass valve 1752. In other words, the first bypass hole 1512*a* may be open and closed by the first bypass valve 1751, and the second bypass hole 1512*b* may be open and closed by the second bypass valve 1752, respectively.

The first bypass valve 1751 and the second bypass valve 1752 may be formed separately or integrally. This embodiment will be described focusing on an example in which the first bypass valve 1751 and the second bypass valve 1752 are separated from each other. In this case, as the first bypass valve 1751 and the second bypass valve 1752 are symmetrical with each other, hereinafter, the first bypass valve 1751 will be mainly described and description of the second bypass valve 1752 is the same as the description of the first bypass valve 1751, and repetitive disclosure has been omitted.

The first bypass valve 1751 may include first fixing portion 1751*a*, first opening/closing portion 1751*b*, and first elastic portion 1751*c*. The first fixing portion 1751*a* is a portion by which the first bypass valve 1751 is fixed between the non-orbiting scroll 150 and the back pressure chamber assembly 160, the first opening/closing portion 1751*b* is a portion that opens and closes the first bypass hole, and the first elastic portion 1751*c* is a portion that connects the first fixing portion 1751*a* and the first opening/closing portion 1751*b* so that the first opening/closing portion 1751*b* operates elastically relative to the first fixing portion 1751*a*.

The first fixing portion 1751*a* may be formed in various shapes. For example, the first fixing portion 1751*a* may be formed in substantially the same shape as a cross-sectional shape of the first valve fixing groove 1561 described hereinafter, that is, may be formed in a circular cross-sectional shape. Accordingly, the first fixing portion 1751*a* may be inserted into the first valve fixing groove 1561 to be fixed to the non-orbiting scroll 150 by a first valve fastening member 181 described hereinafter.

The first fixing portion 1751*a* may be formed in a closed shape, but as illustrated in this embodiment, a first valve support hole 1751*d* may be formed through a center of the first fixing portion 1751*a* in the axial direction. In this case, a first retainer support hole 1761*a* may be formed through a first retainer 1761 described hereinafter in the axial direction, and the first protrusion accommodating groove 1561*c* may be recessed into the first valve support surface 1561*b*. The first retainer support hole 1761*a* and the first protrusion accommodating groove 1561*c* may be formed on a same axis as the first valve support hole 1751*d*. Accordingly, the first valve support protrusion 1813 of a first valve fastening member 181 described hereinafter may be inserted into the first protrusion accommodating groove 1561*c* sequentially through the first retainer support hole 1761*a* and the first valve support hole 1751*d*.

The first bypass valve 1751 and the first retainer 1761 may be axially fixed by being tightly pressed between an end portion of the first valve fastening member 181, that is, an end surface of the first valve fixing portion and the first valve support surface 1561*b*, and simultaneously may be radially supported by the first valve support protrusion 1813 of the first valve fastening member 181. Therefore, the first bypass valve 1751 and the first retainer 1761 may be tightly fixed in the first valve fixing groove 1561 without trembling or vibrating.

The first opening/closing portion 1751*b* may alternatively be formed to correspond to the shape of the first bypass hole 1512*a*. For example, when the first bypass hole 1512*a* is configured as a single hole, the first opening/closing portion 1751*b* may be formed in a circular shape, but when the first bypass hole 1512*a* is configured as a plurality of holes which are arranged linearly, the first opening/closing portion 1751*b* may be formed in a rectangular shape. This embodiment illustrates an example in which the first bypass hole 1512*a* is configured as a plurality of holes arranged linearly and the first opening/closing portion 1751*b* is formed in a rectangular shape.

The first opening/closing portion 1751*b* may be accommodated in the valve opening/closing groove 157 described hereinafter. The valve opening/closing groove 157, which will be described hereinafter, may be recessed by a preset or predetermined depth to be lower than the rear surface 151*a* of the non-orbiting end plate 151. As a result, axial length L2 of the first bypass hole 1512*a* may be shortened, so that the dead volume in the first bypass hole 1512*a* may decrease.

Referring to FIGS. 3 and 6, the first elastic portion 1751*c*, as aforementioned, connects the first fixing portion 1751*a* and the first opening/closing portion 1751*b*. A width W13 of the first elastic portion 1751*c* may be narrower than or equal to a width W11 of the first fixing portion 1751*a* and/or a width W12 of the first opening/closing portion 1751*b*. This embodiment illustrates an example in which the width W13 of the first elastic portion 1751*c* is narrower than the width W11 of the first fixing portion 1751*a* and the width W12 of the first opening/closing portion 1751*b*. Accordingly, the stepped surface 1561*d* may be formed between the first fixing portion 1751*a* and the first elastic portion 1751*c*, such that the first fixing portion 1751*a* may be supported in the first valve fixing groove 1561 described hereinafter in the radial direction, more precisely, in a longitudinal direction of the first bypass valve 1751.

Referring to FIGS. 3 and 4, the first retainer 1761 may be formed in a shape approximately similar to the shape of the first bypass valve 1751. For example, similar to the first bypass valve 1751, the first retainer 1761 may be formed in a rectangular shape that is elongated along the longitudinal direction. One or a first end of the first retainer 1761 defines a fixed end that is in close contact with the first fixing portion 1751*a* of the first bypass valve 1751 to be fixed by the first valve fastening member 181 described hereinafter, and another or a second end of the retainer 1761 defines a free end that is bent (curved) in a direction away from the valve seating surface 1571 of the non-orbiting scroll 150.

The first end of the first retainer 1761 facing the first fixing portion 1751*a* of the first bypass valve 1751 may be formed in a closed shape, or a first retainer support hole 1761*a* may be formed through the first end of the first retainer 1761 on the same axis as the first valve support hole 1751*d* of the first fixing portion 1751*a*. This embodiment illustrates an example in which the first retainer support hole 1761*a* is formed through the first end of the first retainer 1761. Accordingly, the first retainer 1761 may be radially supported by the first valve support protrusion 1813 of the first valve fastening member 181 that is inserted through the first retainer support hole 1761*a*.

The second bypass valve 1752 may include a second fixing portion 1752*a*, a second opening/closing portion 1752*b*, and a second elastic portion 1752*c*. The second fixing portion 1752*a* is a portion defining a fixed end of the second bypass valve 1752 and corresponds to the first fixing portion 1751*a*, the second opening/closing portion 1752*b* is a portion defining a free end of the second bypass valve 1752 and corresponds to the first opening/closing portion 1751*b*, and the second elastic portion 1752*c* is a portion that connects the second fixing portion 1752*a* and the second opening/closing portion 1752*b* and corresponds to the first elastic portion 1751*c*. Therefore, description of the second bypass valve 1752 is the same as the description of the first bypass valve 1751, and repetitive disclosure has been omitted.

Although not illustrated in the drawings, the first retainer 1761 and the second retainer 1762 may be formed integrally with each other on the rear surface 161*a* of the back pressure plate 161 facing the non-orbiting scroll 150. This may eliminate not only manufacturing costs for the retainer but also an assembly process for the retainer, thereby reducing manufacturing costs for the compressor.

The valve fastening members 181 and 182 may include the first valve fastening member 181 that fastens the first bypass valve 1751 to the non-orbiting scroll 150, and second valve fastening member 182 that fastens the second bypass valve 1752 to the non-orbiting scroll 150. Accordingly, the first bypass valve 1751 and the second bypass valve 1752 may be independently fastened by the valve fastening members 181 and 182, respectively. As the first valve fastening member 181 and the second valve fastening member 182 are symmetrical with each other, hereinafter, the first valve fastening member 181 will be mainly described and description of the second valve fastening member 182 is the same as the description of the first valve fastening member 181, and repetitive disclosure has been omitted.

Referring to FIGS. 3 and 4, the first valve fastening member 181 according to this embodiment may include first fastening member fixing portion 1811, a first valve fixing portion 1812, a first valve support protrusion 1813, and a first fastening member head portion 1814. The first fastening member fixing portion 1811 is a portion where the first valve fastening member 181 is fixed to the non-orbiting scroll 150, the first valve fixing portion 1812 is a portion where the first valve fastening member 181 fixes the first bypass valve 1751 to the non-orbiting scroll 150 together with the first retainer 1761, the first valve support protrusion 1813 is a portion where the first valve fastening member 181 radially fixes the first bypass valve 1751 to the non-orbiting scroll 150 together with the first retainer 1761, and the first fastening member head portion 1814 is a portion for fastening the first fastening member fixing portion 1811 to the non-orbiting scroll 150. The first valve support protrusion 1813 may be excluded depending on the first bypass valve 1751 (or first retainer). However, in this embodiment, an example in which the first valve support protrusion 1813 is provided will be described, and another example in which the first valve support protrusion 1813 is excluded will be described hereinafter.

More specifically, the first fastening member fixing portion 1811 may be formed in a cylindrical or circular rod shape, and an outer circumferential surface of the first fastening member fixing portion 1811 may correspond to an inner circumferential surface of the first valve fixing groove 1561, that is, the first fastening member fixing surface 1561*a*. For example, a second screw thread may be formed on the outer circumferential surface of the first fastening member fixing portion 1811, and may be screwed into a first screw thread provided on the inner circumferential surface of the first fastening member fixing surface 1561*a* facing the second screw thread. Accordingly, the first fastening member fixing portion 1811 of the first valve fastening member 181 may be fastened to the first valve fixing groove 1561 of the non-orbiting scroll 150.

An axial length L3 of the first fastening member fixing portion 1811 may be equal to or slightly smaller than the axial depth D1 of the first valve fixing groove 1561. In other words, the axial length L3 of the first fastening member fixing portion 1811 may be equal to or slightly smaller than an axial height H1 from the first valve support surface 1561*b* to the rear surface 151*a* of the non-orbiting scroll 150. Accordingly, the axial length L3 of the first fastening member fixing portion 1811 may be significantly longer than an axial length L4 of the first valve support protrusion 1813.

In this case, the axial height H1 from the first valve support surface 1561*b* to the rear surface 151*a* of the non-orbiting scroll 150 may be at least twice larger than a plate thickness (hereinafter, "second plate thickness") T2 from the valve seating surface 1571 to the compression chamber V, which is the thickness of the non-orbiting end plate 151 in the valve opening/closing groove 157. This may secure a sufficient fastening thickness for the first valve fastening member 181. Accordingly, the first fastening member fixing portion 1811 of the first valve fastening member 181 may be firmly fastened to the first valve fixing groove 1561 of the non-orbiting scroll 150.

Referring to FIG. 4, the first valve fixing portion 1812 may be defined by one axial side surface of the first valve fastening member 181, that is, a lower surface of the first valve fastening member 181 that faces the first valve support surface 1561*b* in the axial direction. Accordingly, the first valve fixing portion 1812 fixedly presses the first fixing portion 1751*a* of the first bypass valve 1751, more precisely, one end of the first retainer 1761 toward the first valve support surface 1561*b* in the axial direction.

The first valve fixing portion 1812 may be formed flat, or may have roughness so as to firmly fix the first retainer 1761 that comes in contact with the first valve fixing portion 1812. For example, when the first valve fastening member 181 is a fastening bolt which is screwed, the first valve fastening portion 1812 may be formed flat, but when the first valve fastening member 181 is a fastening rivet which is press-fitted, the first valve fixing portion 1812 may have roughness. Through this, the first valve fixing portion 1812 may firmly fix the first bypass valve 1751 together with the first retainer 1761.

Referring to FIG. 4, the first valve support protrusion 1813 may extend from one or a first end of the first fastening member fixing portion 1811, that is, the lower end of the first valve fixing portion 1812 toward the first valve support surface 1561*b*. For example, the first valve support protrusion 1813 may extend from a center of the first valve fixing portion 1812 by a preset or predetermined length.

More specifically, an axial length L4 of the first valve support protrusion 1813 may be long enough for the first valve support protrusion 1813 to be inserted into the first protrusion accommodating groove 1561*c* of the first valve support surface 1561*b* sequentially through the first retainer support hole 1761*a* of the first retainer 1761 and the first valve support hole 1751*d* of the first bypass valve 1751. In other words, the axial length L4 of the first valve support protrusion 1813 may be shorter than the axial length L3 of the first fastening member fixing portion 1811. Accordingly, the second plate thickness T2 of the non-orbiting end plate 151 may be reduced, so as to shorten the axial length L1 of the first bypass hole 1512*a* and firmly support the first bypass valve 1751 and the first retainer 1761 in the radial direction.

Referring to FIG. 4, the first fastening member head 1814 may extend from another or a second end of the first fastening member fixing portion 1811, that is, from an upper end of the first valve fixing portion 1812 toward the back pressure chamber assembly 160. For example, the first fastening member head 1814 may extend to protrude from the rear surface 151*a* of the non-orbiting scroll 150 by a preset or predetermined height. Accordingly, the axial length L3 of the first fastening member fixing portion 1811 fastened to the non-orbiting scroll 150 may be sufficiently secured so that the first valve fastening member 181 may stably fix the first bypass valve 1751 and the first retainer 1761.

When the first fastening member head 1814 protrudes from the rear surface 151*a* of the non-orbiting scroll 150, a fastening member accommodating groove 1611*c* in which the first fastening member head 1814 is inserted may be formed in the rear surface of the back pressure chamber assembly 160, that is, the rear surface 161*a* of the back pressure plate 161. This may tightly seal the non-orbiting scroll 150 and the back pressure chamber assembly 160 while significantly securing the axial length L3 of the first fastening member fixing portion 1811 fastened to the non-orbiting scroll 150.

Although not illustrated in the drawings, the first fastening member head 1814 may be excluded and a fastening groove (not illustrated) may be formed in the upper end of the first fastening member fixing portion 1811. In this case, the first fastening member accommodating groove 1611*c* does not need to be formed in the rear surface 161*a* of the back pressure chamber assembly 160 (or back pressure plate), which may facilitate machining and assembling of the back pressure chamber assembly 160.

The second valve fastening member 182 may includes a second fastening member fixing portion 1821, a second valve fixing portion 1822, a second valve support protrusion 1823, and a second fastening member head 1824. The second fastening member fixing portion 1821 is a portion where the second valve fastening member 182 is fixed to the non-orbiting scroll 150 and corresponds to the first fastening member fixing portion 1811, the second valve fixing portion 1822 is a portion where the second bypass valve 1752 is axially fixed to the non-orbiting scroll 150 together with the second retainer 1762 and corresponds to the first valve fixing portion 1812, the second valve support protrusion 1823 is a portion where the second bypass valve 1752 is radially fixed to the non-orbiting scroll 150 together with the second retainer 1762 and corresponds to the first vale support protrusion 1813, and the second fastening member head 1824 is a portion for fastening the second valve fastening member 1821 to the non-orbiting scroll 150 and corresponds to the first fastening member head 1814. Therefore, description of the second valve fastening member 182 is the same as the description of the first valve fastening member 181, and repetitive disclosure has been omitted.

Although not illustrated in the drawings, the first valve fastening member 181 and the second valve fastening member 182 may be excluded, and the first bypass valve 1751 and the second bypass valve 1752 may alternatively be fastened to the non-orbiting scroll 150 using a back pressure fastening member 185 for fastening the non-orbiting scroll 150 and the back pressure chamber assembly 160. In this case, as the separate first and second valve fastening members 181 and 182 are excluded, the number of components may be reduced and an assembling process simplified accordingly. This may be equally applied even to the case where the discharge valve 171 is configured as a reed valve.

In the drawing, unexplained reference numeral 1711 denotes a valve spring, and 1762*a* denotes a second retainer support hole.

The scroll compressor according to embodiments disclosed herein may operate as follows.

That is, when power is applied to the drive motor 120 and a rotational force is generated, the orbiting scroll 140 eccentrically coupled to the rotary shaft 125 performs an orbiting motion relative to the non-orbiting scroll 150 by Oldham ring 190. At this time, first compression chamber V1 and second compression chamber V2 that continuously move are formed between the orbiting scroll 140 and the non-orbiting scroll 150. Then, the first compression chamber V1 and the second compression chamber V2 are gradually reduced in volume moving from the suction port (or suction chamber) 1531 to the discharge port (or discharge chamber) 1511 during the orbiting motion of the orbiting scroll 140.

At this time, refrigerant is suctioned into the low-pressure portion 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

The refrigerant is compressed while moving along moving paths of the first compression chamber V1 and the second compression chamber V2. The compressed refrigerant partially flows into the back pressure chamber 160*a* formed by the back pressure plate 161 and the floating plate 165 through the first back pressure hole 1513 and the second back pressure hole 1611*b* before reaching the discharge port 1511. Accordingly, the back pressure chamber 160*a* forms an intermediate pressure.

The floating plate 165 may rise toward the high/low pressure separation plate 115 to be brought into close contact with the sealing plate 1151 provided on the high/low pressure separation plate 115. Then, the high-pressure portion 110*b* of the casing 110 may be separated from the low-pressure portion 110*a*, to prevent the refrigerant discharged from each compression chamber V1 and V2 from flowing back into the low-pressure portion 110*a*.

On the other hand, the back pressure plate 161 is pressed down toward the non-orbiting scroll 150 by pressure of the back pressure chamber 160*a*. Then, the non-orbiting scroll 150 is pressed toward the orbiting scroll 140. Accordingly, the non-orbiting scroll 150 may be brought into close contact with the orbiting scroll 140, thereby preventing the refrigerant inside of both compression chambers from leaking from a high-pressure compression chamber forming an intermediate pressure chamber to a low-pressure compression chamber.

The refrigerant is compressed to a set or predetermined pressure while moving from the intermediate pressure chamber toward a discharge pressure chamber. This refrigerant moves to the discharge port 1511 and presses the discharge valve 171 in an opening direction. Responsive to this, the discharge valve 171 is pushed up along the valve guide groove 1612*b* by pressure of the discharge pressure chamber, so as to open the discharge port 1511. Then, the refrigerant in the discharge pressure chamber flows to the high-pressure portion 110*b* through the discharge port 1511 and the intermediate discharge port 1612*a* provided in the back pressure plate 161.

Pressure of the compression chamber may rise above a preset or predetermined pressure during operation of the compressor. Then, the refrigerant moving from the intermediate pressure chamber to the discharge pressure chamber is partially bypassed in advance from the intermediate pressure chambers forming the respective compression chambers V1 and V2 toward the high-pressure portion 110*b* through the first bypass hole 1512*a* and the second bypass hole 1512*b* before reaching the discharge pressure chambers, so as to be suppressed or prevented from being overcompressed in the compression chambers V1 and V2.

Figure 7:
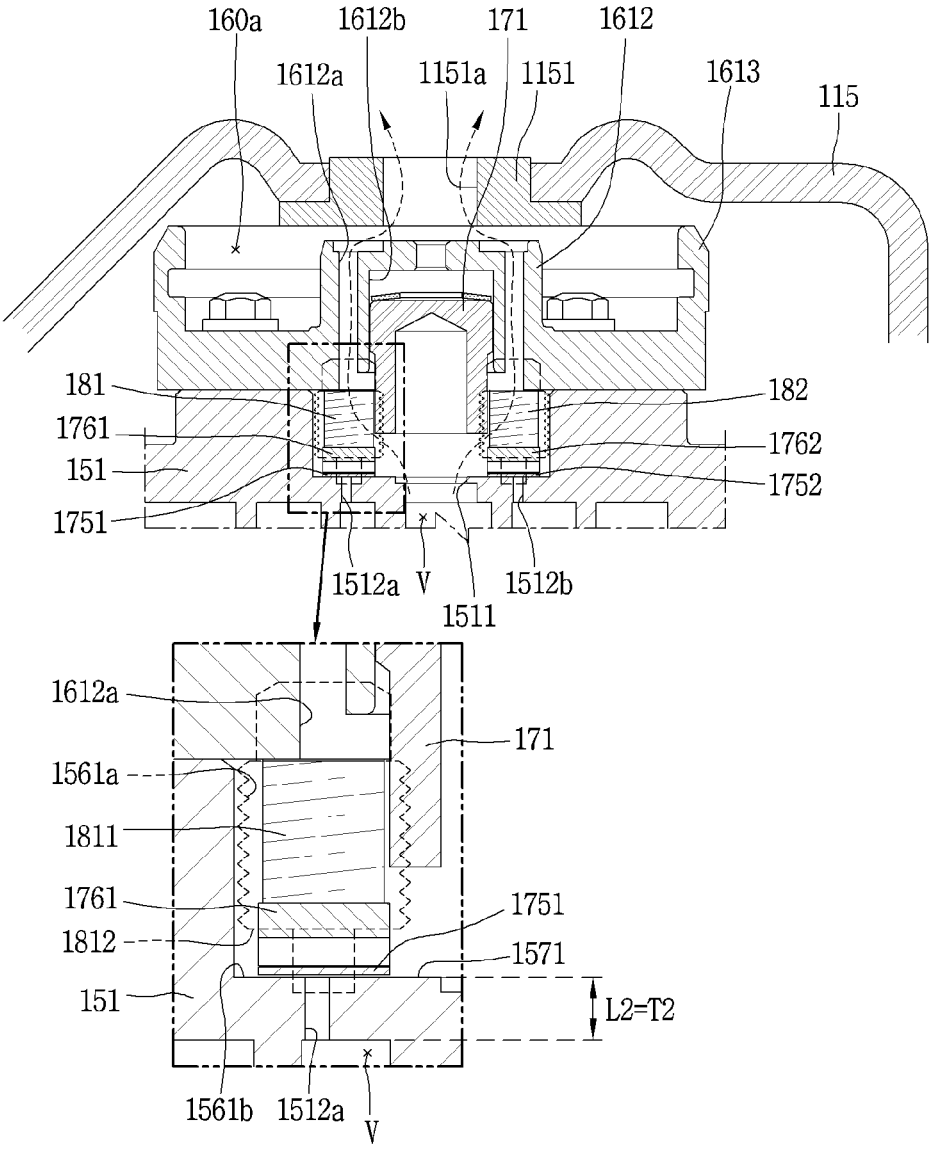
FIG. 7 is a cross-sectional view illustrating a process of discharging refrigerant of a compression chamber in FIG. 2.

FIG. 7 is a cross-sectional view illustrating a process of discharging refrigerant of a compression chamber in FIG. 2. Referring to FIG. 7, when pressure in the first compression chamber V1 and pressure in the second compression chamber V2 are higher than a set or predetermined pressure, the refrigerant compressed in the first compression chamber V1 moves to the first bypass hole 1512*a*, and the refrigerant in the second compression chamber V2 moves to the second bypass hole 1512*b*. Then, the refrigerant moving to these bypass holes 1512*a* and 1512*b* pushes up the first opening/closing portion 1751*b* of the first bypass valve 1751 and the second opening/closing portion 1752*b* of the second bypass valve 1752 that close the first bypass hole 1512*a* and the second bypass hole 1512*b*.

The first opening/closing portion 1751*b* rotates on the first fixing portion 1751*a* together with the first elastic portion 1751*c*, and the second opening/closing portion 1752*b* rotates on the second fixing portion 1752*a* together with the second elastic portion 1752*c*, so as to be spaced apart from the first bypass hole 1512*a* and the second bypass hole 1512*b*. As the first bypass hole 1512*a* and the second bypass hole 1512*b* are opened, the refrigerant in the first compression chamber V1 and the refrigerant in the second compression chamber V2 flow to the valve opening/closing groove 157 through the first bypass hole 1512*a* and the second bypass hole 1512*b*, respectively. This refrigerant flows to the high-pressure portion 110*b*, together with the refrigerant discharged to the valve opening/closing groove 157 through the discharge port 1511, through the intermediate discharge port 1612*a* of the back pressure plate 161. Accordingly, the refrigerant compressed in the compression chamber V may be suppressed or prevented from being overcompressed to a set or predetermined pressure or higher, thereby suppressing or preventing damage to the orbiting wrap 142 and/or the non-orbiting wrap 152 and improving compressor efficiency.

At this time, the first fixing portion 1751*a* of the first bypass valve 1751 and the second fixing portion 1752*b* of the second bypass valve 1752 are fixedly pressed in the axial direction by the first valve fixing portion 1812 of the first valve fastening member 181 and the second valve fixing portion of the second valve fastening member, respectively, and simultaneously fixedly caught in the radial direction (longitudinal direction) by the first valve support protrusion 1813 of the first valve fastening member 181 and the second valve support protrusion of the second valve fastening member. Accordingly, the first fixing portion 1751*a* of the first bypass valve 1751 and the second fixing portion 1752*a* of the second bypass valve 1752 may be stably maintained in a fixed state without being separated from the first valve fixing groove 1561 and the second valve fixing groove 1562, respectively.

In addition, the first elastic portion 1751*c* of the first bypass valve 1751 is supported in an inserted state in the first valve support groove 1581 and the second elastic portion 1752*c* of the second bypass valve 1752 is supported in an inserted state in the second valve support groove 1682, in the radial direction (widthwise direction). Accordingly, the first opening/closing portion 1751*b* of the first bypass valve 1751 and the second opening/closing portion 1752*b* of the second bypass valve 1752 stably open and close the first bypass hole 1512*a* and the second bypass hole 1512*a* while keeping their positions.

Thereafter, when overcompression of the compression chamber V is resolved and proper pressure is formed in the compression chamber V, the first opening/closing portion 1751*b* of the first bypass valve 1751 rotates to be unbent (unfolded) together with the first elastic portion 1751*c* based on the first fixing portion 1751*a*, and the second opening/closing portion 1752*b* of the second bypass valve 1752 rotates to be unbent together with the second elastic portion 1852*c* based on the second fixing portion 1752*a*, thereby closing the first bypass hole 1512*a* and the second bypass hole 1512*b*, respectively. This series of processes is repeated.

High-pressure refrigerant which has not yet been discharged is trapped in the first bypass hole 1512*a* and the second bypass hole 1512*b*. As the pressure in the compression chamber V rises unnecessarily, the first bypass hole 1512*a* and the second bypass hole 1512*b* form dead volumes. Therefore, it is advantageous in view of decreasing the dead volumes to reduce the lengths of the first bypass hole 1512*a* and the second bypass hole 1512*a* by forming the non-orbiting scroll 150 to have the second plate thickness as thin as possible in the valve opening/closing groove 157 having the first bypass hole 1512*a* and the second bypass hole 1512*b*.

However, as in the related art, when the valve fastening members 181 and 182 that fix the bypass valves 1751 and 1752 are fastened to the non-orbiting scroll 150, the non-orbiting scroll 150 needs a fastening thickness (plate thickness) which is significant for the valve fastening members 181 and 182 to stably fix the bypass valves 1751 and 1752.

In other words, when the valve fastening members 181 and 182 are fastened to the non-orbiting scroll 150 at positions closer to the compression chamber V than the bypass valves 1751 and 1752, there is a limitation in reducing the second plate thickness T2 of the non-orbiting scroll 150 in consideration of the fastening thickness. This may elongate the axial lengths L2 of the first bypass hole 1512*a* and the second bypass hole 1512*b* so as to increase the dead volumes in the first bypass hole 1512*a* and the second bypass hole 1512*b*.

Therefore, in this embodiment, as described above, the fastening member fixing portions 1811 and 1821 of the valve fastening members 181 and 182 are fastened at positions farther away from the compression chambers V than the bypass valves 1751 and 1752. In other words, in this embodiment, the fastening member fixing surfaces 1561*a* and 1562*a* of the valve fixing grooves 1561 and 1562 in which the valve fastening members 181 and 182 are fastened to the non-orbiting scroll 150 are located farther away from the compression chamber V than the valve support surfaces 1561*b* and 1562*b* fixing the bypass valves 1751 and 1752.

Then, the bypass valves 1751 and 1752 may be stably fastened to the non-orbiting scroll 150 and the bypass holes 1512*a* and 1512*b* may be formed in the valve opening/closing groove 157 recessed by the preset or predetermined depth into the rear surface 151*a* of the non-orbiting scroll 150. Through this, the second plate thickness T2 of the non-orbiting scroll 150 in the valve opening/closing groove 157 where the bypass holes 1512*a* and 1512*b* are formed may be formed as thin as possible.

The bypass valves 1751 and 1752 may be stably fastened to the non-orbiting scroll 150 and the lengths of the first bypass hole 1512*a* and the second bypass hole 1512*b* may be minimized. Through this, the dead volumes in the first bypass hole 1512*a* and the second bypass hole 1512*b* may be minimized, thereby enhancing compression efficiency.

These are also similarly applied to the discharge valve 171. In other words, as the discharge port 1511 is formed in the valve opening/closing groove 157, the axial length L1 of the discharge port 1511 may be minimized, and thus, the dead volume in the discharge port 1511 may decrease, thereby enhancing compression efficiency.

Hereinafter, description will be given of another embodiment for an assembly structure of a bypass valve. That is, in the previous embodiment, the valve support portion extends from the lower end of the valve fastening member facing the bypass valve, such that the bypass valve is caught and supported in the radial direction together with the retainer, but in some cases, the valve support portion may be excluded from the lower end of the valve fastening member and the bypass valve may be fixed together with the retainer by fastening force of the valve fastening member in the axial direction.

Figure 8:
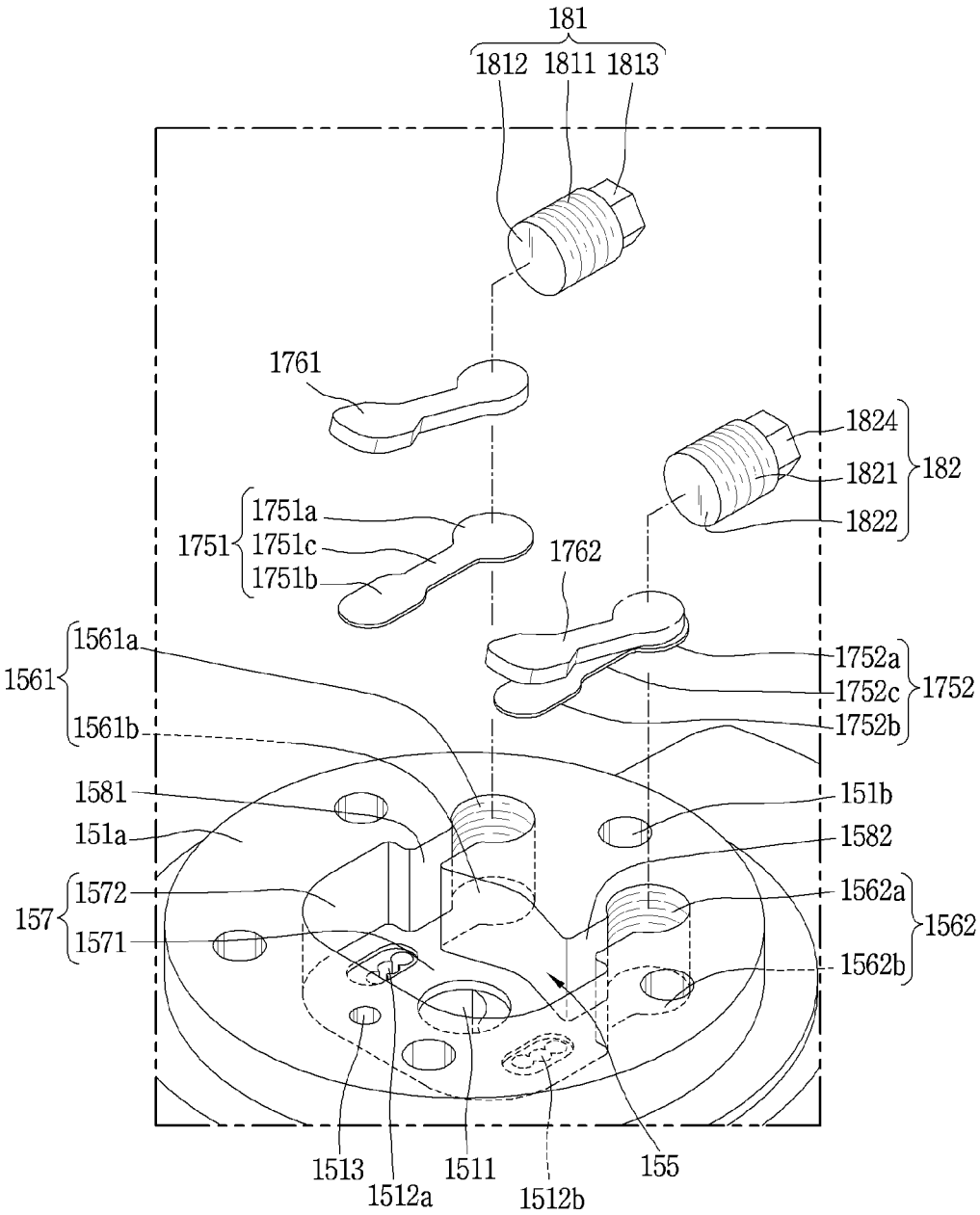
FIG. 8 is an exploded perspective view of an assembling structure of the bypass valves according to another embodiment.
Figure 9:
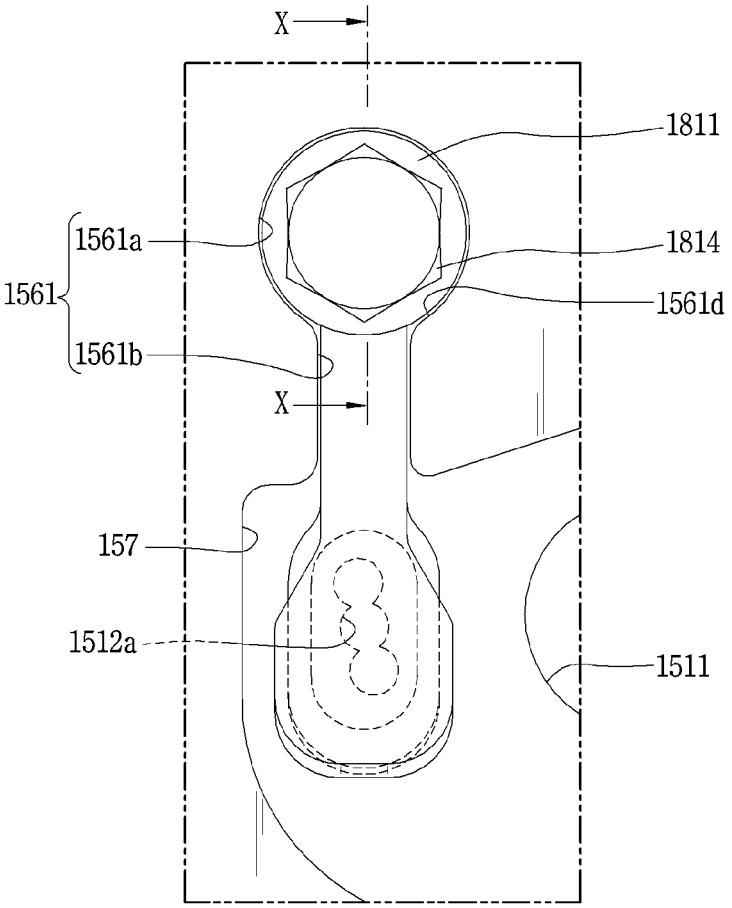
FIG. 9 is an assembled planar view of the bypass valves in FIG. 8.
Figure 10:
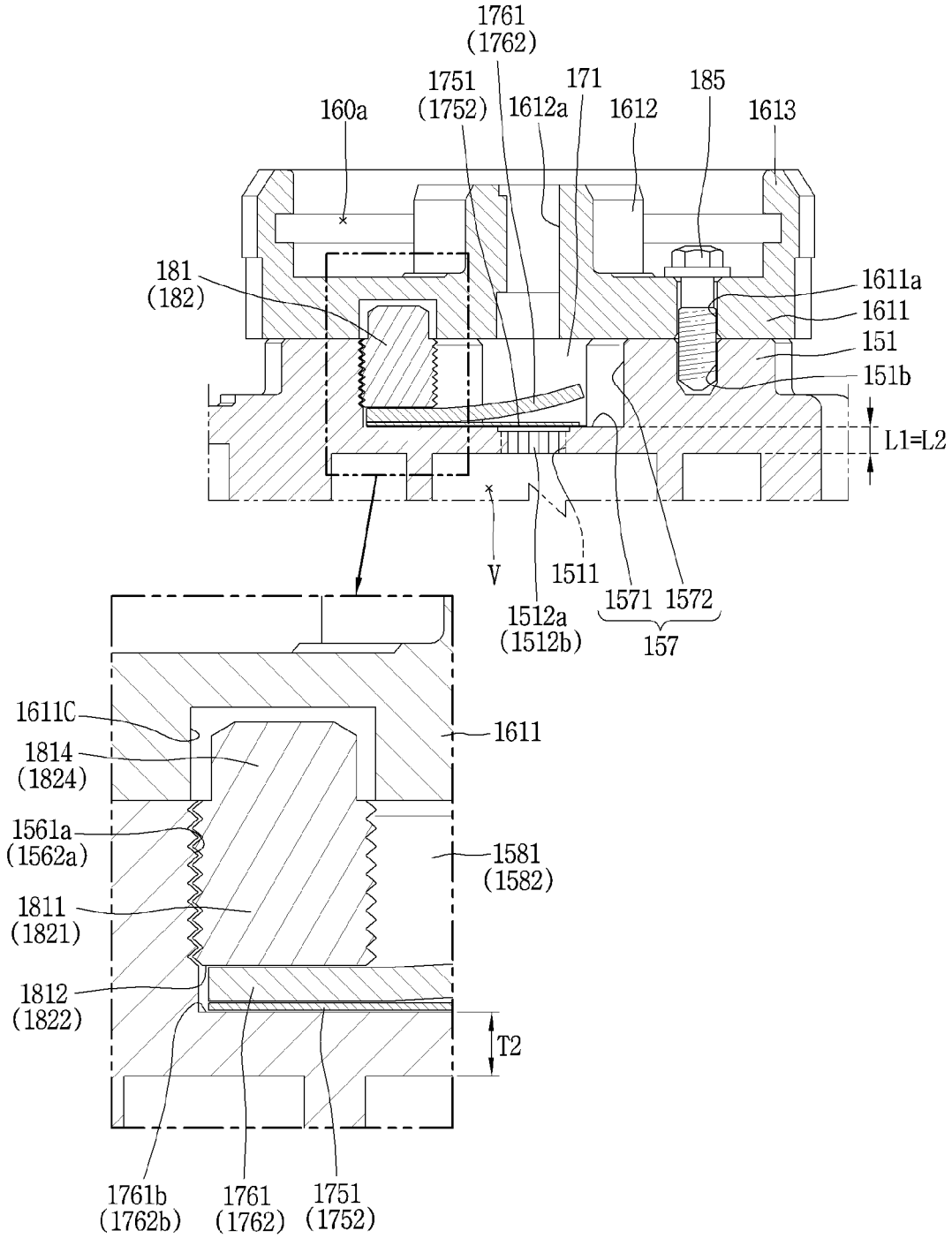
FIG. 10 is a cross-sectional view, taken along line "X-X" of FIG. 9.

FIG. 8 is an exploded perspective view of an assembling structure of the bypass valves according to another embodiment. FIG. 9 is an assembled planar view of the bypass valves in FIG. 8. FIG. 10 is a cross-sectional view, taken along line "X-X" of FIG. 9.

Referring to FIGS. 8 to 10, the scroll compressor according to this embodiment may include the discharge valve 171 and the bypass valves 1751 and 1752 between the non-orbiting scroll 150 and the back pressure chamber assembly 160, so as to open and close the discharge port 1511 and the bypass holes 1512*a* and 1512*b*. The basic configuration of the non-orbiting scroll 150 and the back pressure chamber assembly 160 including the discharge valve 171 and the bypass valves 1751 and 1752 and their operating effects are similar to those of the previous embodiment.

For example, the valve fixing grooves 1561 and 1562 may be recessed by a preset or predetermined depth into the rear surface 151*a* of the non-orbiting end plate 151. The valve opening/closing groove 157 may be recessed by a depth of the valve fixing grooves 1561 and 1562 at one side of the valve fixing grooves 1561 and 1562, and the valve support grooves 1581 and 1582 may be recessed by a depth of the valve fixing grooves 1561 and 1562 and the valve opening/closing groove 157 between the valve fixing grooves 1561 and 1562 and the valve opening/closing groove 157. Accordingly, the valve fixing grooves 1561 and 1562, the valve opening and closing groove 157, and the valve support grooves 1581 and 1582 may be recessed by a same depth and connected to one another.

Each of the valve fixing grooves 1561 and 1562 may include the fastening member fixing surface 1561*a*, 1562*a* and the valve support surface 1561*b*, 1562*b*, and the bypass holes 1512*a* and 1512*b* (and the discharge port) may be formed in the valve opening/closing groove 157. The fastening member fixing surfaces 1561*a* and 1562*a* and the bypass holes 1512*a* and 1512*b* (and the discharge port) may be the same as those of the embodiment of FIG. 3. Accordingly, the bypass valves 1751 and 1752 may be firmly fastened to the rear surface 151*a* of the non-orbiting scroll 150 together with the retainers 1761 and 1762, and also the axial length of the bypass holes 1512*a* and 1512*b* (and the discharge port) may be minimized, thereby decreasing the dead volumes in the bypass holes 1512*a* and 1512*b* (and the discharge port).

However, the valve support surfaces 1561*b* and 1562*b* and the lower ends of the valve fastening members 181 and 182 facing them according to this embodiment may be formed flat. In other words, as the valve support protrusions 1813 and 1823 illustrated in the previous embodiment are excluded from the lower ends of the valve fastening members 181 and 182 according to this embodiment, the protrusion accommodating grooves 1561*c* and 1562*c* illustrated in the previous embodiment may also be excluded from the valve support surfaces 1561*b* and 1562*b* facing the valve support protrusions 1813 and 1823. As described above, when the valve support protrusions 1813 and 1823 are excluded from the lower ends of the valve fastening members 181 and 182 and the protrusion accommodating grooves 1561*c* and 1562*c* are excluded from the valve support surfaces 1561*b* and 1562*b*, the structure for fixing the bypass valves 1751 and 1752 and the retainers 1761 and 1762, that is, the structure of the valve fastening members 181 and 182 and/or the valve support surfaces 1561*b* and 1562*b* may be simplified, which may result in simplifying manufacturing and assembling processes of the valve fastening members 181 and 182 and/or the non-orbiting scroll 150.

However, as illustrated in this embodiment, when the valve support protrusions 1813 and 1823 are excluded from the lower ends of the valve fastening members 181 and 182 and the protrusion accommodating grooves 1561*c* and 1562*c* are excluded from the valve support surfaces 1561*b* and 1562*b* facing the valve support protrusions 1813 and 1823, the bypass valves 1751 and 1752 and the retainers 1761 and 1762 placed on the valve support surfaces 1561*b* and 1562*b* are pressed and supported in the axial direction by the valve fixing portions 1812 and 1822 of the valve fastening members 181 and 182. This may somewhat deteriorate assembly reliability of the bypass valves 1751 and 1752 and the retainers 1761 and 1762.

However, as described above, the axial depth D1 of the fastening member fixing surfaces 1561*a* and 1562*a* for fastening the valve fastening members 181 and 182 is longer than half the second plate thickness T2 of the non-orbiting end plate 151. This may secure a sufficient fastening thickness for the valve fastening members 181 and 182. Accordingly, the valve fastening members 181 and 182 may be firmly fastened to the non-orbiting scroll 150 (to be precise, the non-orbiting end plate), and the bypass valves 1751 and 1752 and the retainers 1761 and 1762 may be strongly pressed against the valve support surfaces 1561*b* and 1562*b*. Accordingly, even if the valve support protrusions 1813 and 1823 are not provided on the valve fastening members 181 and 182, the bypass valves 1751 and 1752 and the retainers 1761 and 1762 may be firmly fixed to the non-orbiting scroll 150.

At the same time, when a width W21 of each of the valve fixing grooves 1561 and 1562 into which the fixing portions 1751*a* and 1752*a* of the bypass valves 1751 and 1752 are inserted is wider than a width 23 of each of the valve support grooves 1581 and 1582 into which the elastic portions 1751*c* and 1752*c* of the bypass valves 1751 and 1752 are inserted, stepped surfaces 1561*d* each forming a kind of stopping jaw may be formed between the valve fixing grooves 1561 and 1562 and the valve support grooves 1581 and 1582. Accordingly, even if the valve support protrusions 1813 and 1823 are not formed on the valve fastening members 181 and 182, the bypass valves 1751 and 1752 and the retainers 1761 and 1762 may be suppressed or prevented from being separated not only in a widthwise direction but also in a longitudinal direction toward the opening/closing portions 1751*b* and 1752*b* of the bypass valves 1751 and 1752.

Hereinafter, description will be given of a discharge valve according to another embodiment. That is, in the previous embodiments, the discharge valve is configured as a piston valve, but in some cases, the discharge valve may alternatively be configured as a reed valve.

Figure 11:
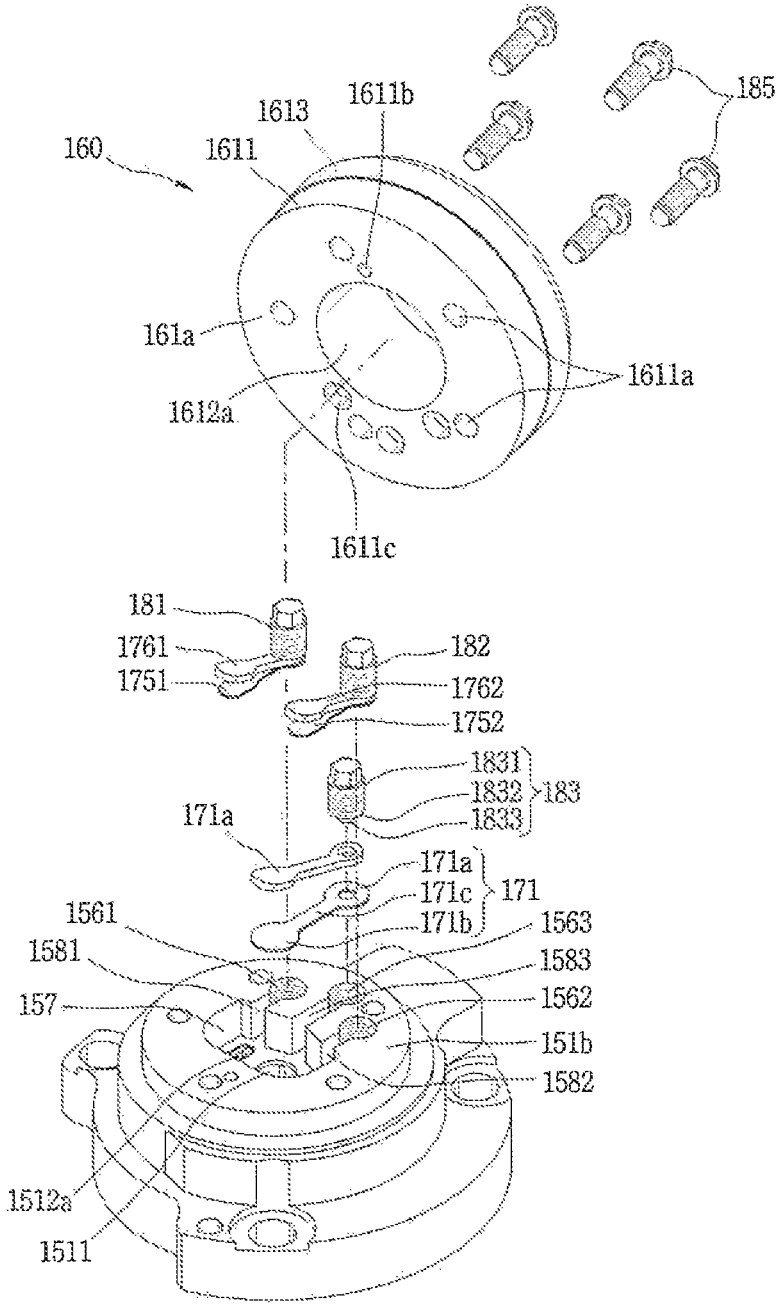
FIG. 11 is an exploded perspective view of a discharge valve according to another embodiment.
Figure 12:
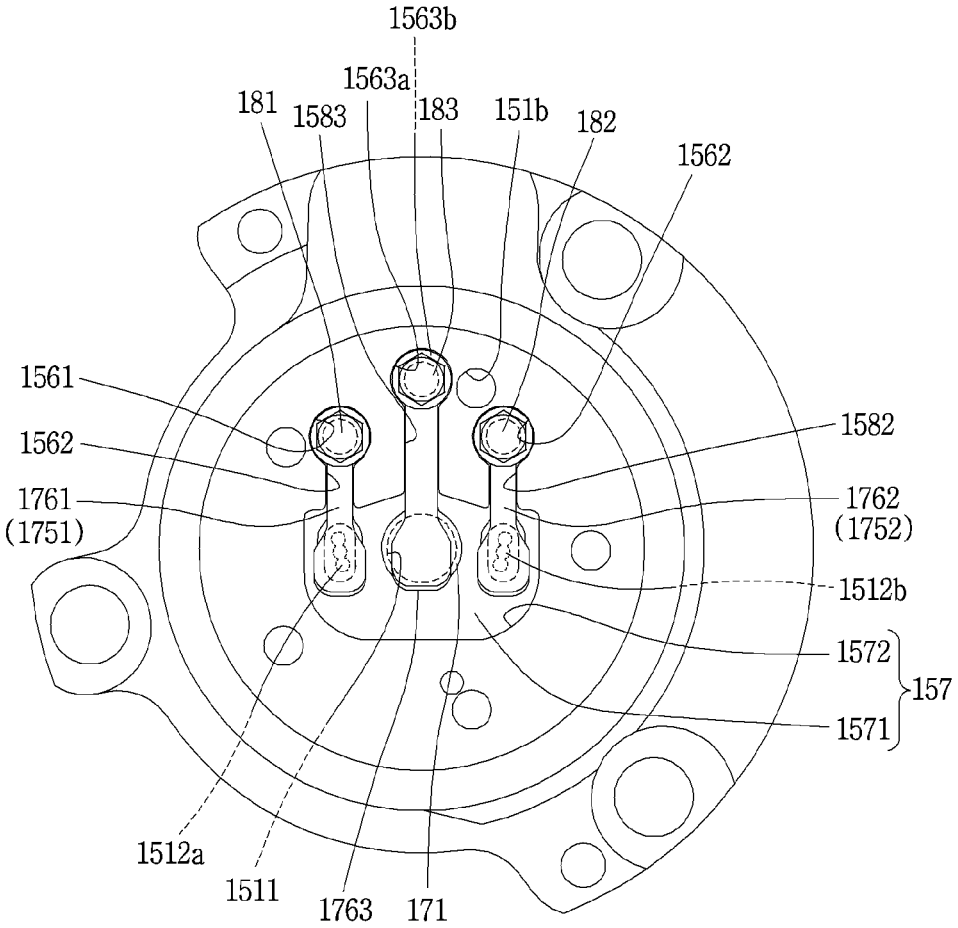
FIGS. 12 and 13 are a planar view and a cross-sectional view illustrating a state in which the discharge valve and the bypass valves are assembled in FIG. 11.
Figure 13:
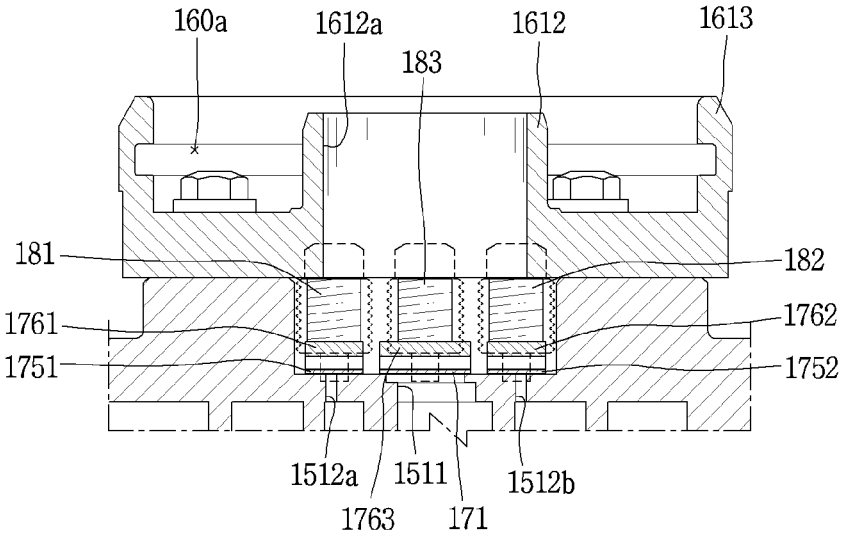

FIG. 11 is an exploded perspective view of a discharge valve according to another embodiment. FIGS. 12 and 13 are a planar view and a cross-sectional view illustrating a state in which the discharge valve and the bypass valves are assembled in FIG. 11.

Referring to FIGS. 11 to 13, the basic structure of the scroll compressor according to this embodiment is similar to those in the previous embodiments. In other words, the scroll compressor according to this embodiment may include casing 110, drive motor 120, main frame 130, orbiting scroll 140, non-orbiting scroll 150, and back pressure chamber assembly 160. Discharge valve 171 and bypass valves 1751 and 1752 may be disposed between the non-orbiting scroll 150 and the back pressure chamber assembly 160. Of the discharge valve 171 and bypass valves 1751 and 1752, the bypass valves 1751 and 1752 may be configured as reed valves as illustrated in the previous embodiments. Accordingly, valve accommodating groove 155, that is, valve fixing grooves 1561 and 1562, valve opening/closing groove 157, and valve support grooves 1581 and 1582 which are illustrated in the previous embodiments may be formed in rear surface 151*a* of the non-orbiting scroll 150. As the basic structures of the valve fixing grooves 1561 and 1562, the valve opening/closing groove 157, and the valve support grooves 1581 and 1582 and their operating effects are the same as those of the previous embodiments, repetitive description thereof has been omitted. This is also similar to the valve fastening members 181 and 182 fixing the bypass valves 1751 and 1752.

However, in this embodiment, the discharge valve 171 may be configured as a reed valve. For example, the discharge valve 171 may include a fixing portion 171*a*, an opening/closing portion 171*b*, and an elastic portion 171*c*. The fixing portion 171*a* is a portion where the discharge valve 171 is fixed to the non-orbiting scroll 150, the opening/closing portion 171*b* is a portion that opens and closes the discharge port 1511, and the elastic portion 171*c* is a portion that elastically connects the fixing portion 171*a* and the opening/closing portion 171*b*. Accordingly, in this embodiment, unlike the previous embodiments, a third valve fixing groove 1563 and a third valve support groove 1583 that fix the discharge valve 171 may further be formed in the rear surface 151*a* of the non-orbiting scroll 150, more precisely, outside of the valve opening/closing groove 157.

More specifically, the third valve fixing groove 1563 may be formed between the first valve fixing groove 1561 and the second valve fixing groove 1562, and the third valve support groove 1583 may be formed between the first valve support groove 1581 and the second valve support groove. Even in this case, the third valve fixing groove 1563 may be connected to the valve opening/closing groove 157 through the third valve support groove 1583.

In other words, the third valve fixing groove 1563 is a portion into which the fixing portion 171*a* of the discharge valve 171 is inserted, and the third valve support groove 1583 is a portion into which the elastic portion 171*c* of the discharge valve 171 is supportedly inserted and simultaneously by which the third valve fixing groove 1563 and the valve opening/closing groove 157 are connected. Accordingly, the third valve fixing groove 1563 and the third valve support groove 1583 may be formed to have a same depth as the valve opening/closing groove 157.

In addition, the third valve fixing groove 1563 may correspond to the first valve fixing groove 1561 and/or the second valve fixing groove 1562, and the third valve support groove 1583 may correspond to the first valve fixing groove 1561 and/or the second valve support groove 1582. For example, the third valve fixing groove 1563 may include a third fastening member fixing surface 1563*a* and a third valve support surface 1563*b*. A third valve fastening member 183 that fixedly presses the fixing portion 171*a* of the discharge valve 171 and a third retainer 1763 onto the third valve support surface 1563*b* may be fastened to the second fastening member fixing surface 1563*a*.

In other words, the third valve fastening member 183, like the first valve fastening member 181 and/or the second valve fastening member 182, may include a third fastening member fixing portion 1831, a third valve fixing portion 1832, and a third valve support protrusion 1833. The structures of the third fastening member fixing portion 1831, the third valve fixing portion 1832, and the third valve support protrusion 1833 and their effects correspond to those of the fastening member fixing portions, the valve fixing portions 1812 and 1822, and the valve support portions 1813 and 1823 illustrated in the embodiment of FIG. 3. Therefore, repetitive description thereof has been omitted.

However, in this embodiment, as the discharge valve 171 as well as the bypass valves 1751 and 1752 are configured as reed valves, a response speed of the discharge valve 171 may be further improved than the case in which the discharge valve 171 is configured as a piston valve. Accordingly, the discharge valve 171 may be rapidly open and closed, which may result in improving compression efficiency and effectively suppressing or preventing a reverse flow of refrigerant in the high-pressure portion 11*b* to the compression chamber V.

In addition, as the discharge valve 171 is configured as the reed valve, a discharge passage may be simplified and a discharge area may be expanded. For example, when the discharge valve 171 is configured as the piston valve as illustrated in the previous embodiments, the valve guide groove 1612*b* is formed in the back pressure plate 161 (or floating plate) and the intermediate discharge port 1612*a* is formed near the valve guide groove 1612*b*. As a result, a cross-sectional area of the intermediate discharge port 1612*a* constituting a discharge passage may decrease, and thus, an overall area of the discharge passage may also decrease, thereby increasing discharge resistance.

However, when the discharge valve 171 is the reed valve as in this embodiment, there is no need to form a separate valve guide groove (not illustrated) in the back pressure plate 161 or the floating plate 165, which may increase the area of the discharge passage (the intermediate discharge port 1612*a*). In this way, discharge resistance may be lowered in the discharge passage, thereby improving performance of the compressor.

Although not illustrated in the drawings, the third valve support protrusion 1833 may alternatively be excluded, as illustrated in the embodiment of FIG. 8. As the operating effects thereof are the same as those of the embodiment of FIG. 8, the description thereof will be replaced with the description of the embodiment of FIG. 8.

On the other hand, as described above, the valve assembly according to embodiments disclosed herein may be equally applied to an open type as well as a hermetic type, to a high-pressure type as well as a low-pressure type, and even to a horizontal type as well as a vertical type. The embodiments disclosed herein may also be equally applied to an orbiting back pressure type or a tip seal type as well as the non-orbiting back pressure type. In particular, in the orbiting back pressure type or the tip seal type, a separate plate, instead of the back pressure chamber assembly 160, may be fixed to the rear surface 151*a* of the non-orbiting scroll 150 (fixed scroll), and the valve assembly of the previous embodiments may be fixed using the plate. Even in this embodiment, the basic configuration of the valve assembly or operational effects thereof may be substantially the same as those of the previous embodiments.

Embodiments disclosed herein provide a scroll compressor capable of suppressing or preventing overcompression and decreasing a dead volume in a compression chamber. Embodiments disclosed herein further provide a scroll compressor capable of reducing lengths of bypass holes and/or a discharge port to decrease dead volumes in the bypass holes and/or the discharge port.

Embodiments disclosed herein provide a scroll compressor capable of securing coupling lengths for bypass valves and/or a discharge valve while reducing lengths of bypass holes and/or a discharge port. Embodiments disclosed herein also provide a scroll compressor capable of facilitating assembly of bypass valves and/or a discharge valve.

Embodiments disclosed herein further provide a scroll compressor capable of reducing lengths of bypass holes and/or a discharge port while fastening bypass valves and/or a discharge valve to a non-orbiting scroll. Embodiments disclosed herein further provide a scroll compressor capable of reducing manufacturing costs by simplifying a fastening structure for bypass valves and/or a discharge valve while fastening these valves to a non-orbiting scroll.

Embodiments disclosed herein provide a scroll compressor that may include a casing, an orbiting scroll, a non-orbiting scroll, a discharge valve, bypass valves, and valve fastening members. The orbiting scroll may perform an orbiting motion by being coupled to a rotary shaft in an inner space of the casing. The non-orbiting scroll may be engaged with the orbiting scroll to define compression chambers, and may include a discharge port and bypass holes through which refrigerant in the compression chambers is discharged. The discharge valve may open and close the discharge port, and the bypass valves may open and close the bypass holes. The valve fastening members may fix the bypass valves to the non-orbiting scroll, and each may include a fastening member fixing portion and a valve fixing portion. The fastening member fixing portion may fix the valve fastening member to the non-orbiting scroll, and the valve fixing portion may fix the bypass valve to the non-orbiting scroll. The fastening member fixing portion may be located farther away from the compression chamber in an axial direction than the valve fixing portion is. This may secure a fastening thickness by which the valve fastening member that fixes the bypass valve is fastened to the non-orbiting scroll and reduce a plate thickness at a portion where the bypass holes and/or the discharge port are formed, thereby decreasing dead volumes in the bypass holes and/or the discharge port.

A valve fixing groove in which the fixing portion of the bypass valve is fixed and a valve opening/closing groove in which an opening/closing portion of the bypass valve is accommodated may be formed in a rear surface of the non-orbiting scroll. The valve fixing groove and the valve opening/closing groove may be spaced apart from each other and recessed by a preset or predetermined depth into the rear surface of the non-orbiting scroll. With this configuration, the bypass valves that are configured as reed valves may be fastened to the non-orbiting scroll and also a plate thickness may be reduced on a portion where the bypass holes are formed.

In another example, a valve fixing groove in which a fixing portion of the bypass valve is fixedly inserted and a valve opening/closing groove in which an opening/closing portion of the bypass valve is accommodated may be formed in a rear surface of the non-orbiting scroll. The valve fixing groove may include a fastening member fixing surface and a valve support surface. The fastening member fixing surface may be provided on an inner circumferential surface of the valve fixing groove so as to fix the valve fastening member, and the valve support surface may be provided on an axial side surface of the valve fixing groove at a position adjacent to the compression chamber than the fastening member fixing surface so as to axially support the fixing portion of the bypass valve. This may reduce an axial length of the bypass hole and secure a fastening thickness of the valve fastening member for fastening the bypass valve to the non-orbiting scroll.

More specifically, an axial length of the fastening member fixing surface may be longer than or equal to an axial length of the bypass hole. This may firmly fasten the valve fastening member to the non-orbiting scroll while reducing the axial length of the bypass hole.

The fastening member fixing portion of the valve fastening member and the fastening member fixing surface facing the fastening member fixing portion may be formed in shapes to be engaged with each other, and the valve fixing portion of the valve fastening member and the valve support surface facing the valve fixing portion may be formed flat. Accordingly, the valve fastening member may press the bypass valve to firmly fix the bypass valve in the axial direction.

A valve support hole may be axially formed through the fixing portion of the bypass valve, and a valve support protrusion may be formed in the valve fastening member and inserted into the valve support hole so as to support the bypass valve in a radial direction. This may suppress or prevent separation of the bypass valve in a longitudinal direction by locking the bypass valve in the radial direction.

For example, an axial length of the valve support protrusion may be shorter than an axial length of the fastening member fixing portion. This may lock and fix the bypass valve in the radial direction and reduce a plate thickness of the non-orbiting scroll, thereby decreasing a dead volume in the bypass hole.

A protrusion accommodating groove in which the valve support protrusion is inserted may be recessed by a preset or predetermined depth into the valve support surface in the axial direction. Through this, the valve fastening member may press the bypass valve in the axial direction while supporting the bypass valve in the radial direction, thereby firmly fixing the bypass valve.

More specifically, an axial depth of the protrusion accommodating groove may be shallower than an axial length of the fastening member fixing surface. This may lock and fix the bypass valve in the radial direction and reduce a plate thickness of the non-orbiting scroll, thereby decreasing a dead volume in the bypass hole.

A retainer that limits an open degree of the bypass valve may be disposed between the bypass valve and the valve fastening member. A retainer support hole may be formed through one end portion of the retainer that faces the fixing portion of the bypass valve and disposed on a same axis as the valve support hole in the axial direction. This may radially lock not only the bypass valve but also the retainer that supports the bypass valve, resulting in preventing separation of the bypass valve and the retainer in a longitudinal direction.

The fixing portion of the bypass valve may be formed in a closed shape. The valve fastening member may be formed such that an end surface of the valve fixing portion facing the fixing portion of the bypass valve is flat. Through this, as the bypass valve is firmly fixed by being pressed in the axial direction, a separate structure for fixing the bypass valve in the radial direction may be eliminated. This may simplify the structure of the valve fastening member, the bypass valve, and the non-orbiting scroll, so as to reduce manufacturing costs.

More specifically, a retainer that limits an open degree of the bypass valve may be disposed between the fixing portion of the bypass valve and the valve fastening member. One end portion of the retainer facing the fixing portion of the bypass valve may be formed in a closed shape. Through this, a separate structure for fixing the bypass valve and the retainer in the radial direction may be excluded, which may simplify the structure of the valve fastening member, the bypass valve, the retainer, and the non-orbiting scroll, thereby reducing manufacturing costs.

A valve fixing groove in which a fixing portion of the bypass valve is fixed and a valve opening/closing groove in which an opening/closing portion of the bypass valve is accommodated may be formed in a rear surface of the non-orbiting scroll. A valve support groove in which an elastic portion of the bypass valve is inserted may be recessed by a preset or predetermined depth between the valve fixing groove and the valve opening/closing groove. A width of the valve support groove may be narrower than a width of the valve fixing groove. This may exclude a separate structure for fixing the bypass valve in the radial direction and may lock the bypass valve in the longitudinal direction. Accordingly, the bypass valve may be stably fixed and the structure of the valve fastening member, the bypass valve, and the non-orbiting scroll may be simplified, thereby reducing manufacturing costs.

One or a first end of the discharge valve may have a fixing portion fixed to the non-orbiting scroll, and another or a second end of the discharge valve may extend from the fixing portion to form an opening/closing portion that opens and closes the discharge port. A third valve fixing groove into which a fixing portion of the discharge valve is fixedly inserted may be formed between a first valve fixing groove and a second valve fixing groove into which the fixing portions of the bypass valves are fixedly inserted. The fixing portion of the discharge valve may be fixed by a third valve fastening member fastened to the third valve fixing groove. The third valve fastening member may be fastened to the third valve fixing groove at a position farther away from the compression chamber than the fixing portion of the discharge valve. Through this, the discharge valve as well as the bypass valve may be configured as reed valves. This may reduce a discharge delay caused by a weight of the discharge valve and expanding a discharge area, thereby improving performance of the compressor.

More specifically, the third valve fixing groove may be spaced apart from the first valve fixing groove and the second valve fixing groove. A valve opening/closing groove that accommodates an opening/closing portion of the discharge valve may be formed at one side of the third valve fixing groove. The valve opening/closing groove may be connected to the first valve fixing groove, the second valve fixing groove, and the third valve fixing groove. Through this, the bypass valve as well as the discharge valve may be configured as reed valves and a structure of the rear surface of the non-orbiting scroll may be simplified, thereby reducing manufacturing costs.

A back pressure chamber assembly may be coupled to the rear surface of the non-orbiting scroll to press the non-orbiting scroll toward the orbiting scroll. A fastening member accommodating groove in which a portion of the valve fastening member is inserted may be formed in a rear surface of the back pressure chamber assembly facing the rear surface of the non-orbiting scroll. Through this, the back pressure chamber assembly and the non-orbiting scroll may be tightly coupled while the bypass valve and/or the discharge valve configured as the reed valves may be easily coupled to the non-orbiting scroll.

More specifically, the valve fastening member may have a fastening member head that fastens the fastening member fixing portion to the non-orbiting scroll. At least a portion of the fastening member head may protrude more than the rear surface of the non-orbiting scroll to be inserted into the fastening member accommodating groove of the back pressure chamber assembly. Through this, the back pressure chamber assembly and the non-orbiting scroll may be tightly coupled in a manner that the valve fastening members that fix the bypass valve and/or the discharge valve configured as the reed valves are hidden in the back pressure chamber assembly.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

an orbiting scroll coupled to a rotary shaft in an inner space of the casing to perform an orbiting motion;

a non-orbiting scroll engaged with the orbiting scroll to define compression chambers, and provided with a discharge port and bypass holes through which refrigerant in the compression chambers is discharged; and a discharge valve that opens and closes the discharge port; bypass valves that open and close the bypass holes; and valve fastening members that fix the bypass valves to the non-orbiting scroll, wherein each of the valve fastening members includes a fastening member fixing portion where the valve fastening member is fixed to the non-orbiting scroll, and a valve fixing portion where the bypass valve is fixed to the non-orbiting scroll, wherein the fastening member fixing portion is located farther away from the compression chambers in an axial direction than the valve fixing portion, wherein a valve fixing groove in which a fixing portion of at least one of the bypass valves is fixedly inserted and a valve opening/closing groove in which an opening/closing portion of at least one of the bypass valves is accommodated are formed in a rear surface of the non-orbiting scroll, and wherein the valve fixing groove includes a fastening member fixing surface provided on an inner circumferential surface thereof so as to fix the valve fastening member, and a valve support surface provided on an axial side surface of the valve fixing groove at a position more adjacent to the compression chambers than the fastening member fixing surface so as to axially support the fixing portion of at least one of the bypass valves.

2. The scroll compressor of claim 1, wherein the valve fixing groove and the valve opening/closing groove are spaced apart from each other and recessed by a predetermined depth into the rear surface of the non-orbiting scroll.

3. The scroll compressor of claim 1, wherein an axial length of the fastening member fixing surface is longer than or equal to an axial length of the bypass hole.

4. The scroll compressor of claim 1, wherein the fastening member fixing portion of the valve fastening member and the fastening member fixing surface facing the fastening member fixing portion are formed in corresponding shapes so as to be engaged with each other, and wherein the valve fixing portion of the valve fastening member and the valve support surface facing the valve fixing portion are flat.

5. The scroll compressor of claim 1, wherein a valve support hole is axially formed through the fixing portion of the bypass valve, and wherein the valve fastening member includes a valve support protrusion inserted into the valve support hole to radially support the bypass valve.

6. The scroll compressor of claim 5, wherein an axial length of the valve support protrusion is shorter than an axial length of the fastening member fixing portion.

7. The scroll compressor of claim 5, wherein a protrusion accommodating groove in which the valve support protrusion is inserted is recessed by a predetermined depth into the valve support surface in the axial direction.

8. The scroll compressor of claim 7, wherein the predetermined depth of the protrusion accommodating groove is shallower than an axial length of the fastening member fixing surface.

9. The scroll compressor of claim 5, wherein a retainer that limits an open degree of the bypass valve is disposed between the bypass valve and the valve fastening member, and wherein a retainer support hole is formed through one end portion of the retainer that faces the fixing portion of the bypass valve and disposed on a same axis as the valve support hole in the axial direction.

10. The scroll compressor of claim 1, wherein the fixing portion of the bypass valve is formed in a closed shape, and wherein the valve fastening member is formed such that an end surface of the valve fixing portion facing the fixing portion of the bypass valve is flat.

11. The scroll compressor of claim 10, wherein a retainer that limits an open degree of the bypass valve is disposed between the fixing portion of the bypass valve and the valve fastening member, and wherein one end portion of the retainer facing the fixing portion of the bypass valve is formed in a closed shape.

12. The scroll compressor of claim 1, wherein a valve support groove in which an elastic portion of the bypass valve is inserted is recessed by a predetermined depth between the valve fixing groove and the valve opening/closing groove, and wherein a width of the valve support groove is narrower than a width of the valve fixing groove.

13. The scroll compressor of claim 1, wherein a first end of the discharge valve has a fixing portion fixed to the non-orbiting scroll, and a second end of the discharge valve extends from the fixing portion to form an opening/closing portion that opens and closes the discharge port, wherein a third valve fixing groove into which a fixing portion of the discharge valve is fixedly inserted is formed between a first valve fixing groove and a second valve fixing groove into which the fixing portions of the bypass valves are fixedly inserted, wherein the fixing portion of the discharge valve is fixed by a third valve fastening member fastened to the third valve fixing groove, and wherein the third valve fastening member is fastened to the third valve fixing groove at a position farther away from the compression chamber than the fixing portion of the discharge valve.

14. The scroll compressor of claim 13, wherein the third valve fixing groove is spaced apart from the first valve fixing groove and the second valve fixing groove, wherein a valve opening/closing groove that accommodates an opening/closing portion of the discharge valve is formed at one side of the third valve fixing groove, and wherein the valve opening/closing groove is connected to the first valve fixing groove, the second valve fixing groove, and the third valve fixing groove.

15. The scroll compressor of claim 1, wherein a back pressure chamber assembly is coupled to the rear surface of the non-orbiting scroll to press the non-orbiting scroll toward the orbiting scroll, and wherein a fastening member accommodating groove in which a portion of the valve fastening member is inserted is formed in a rear surface of the back pressure chamber assembly facing the rear surface of the non-orbiting scroll.

16. The scroll compressor of claim 15, wherein the valve fastening member has a fastening member head that fastens the fastening member fixing portion to the non-orbiting scroll, and wherein at least a portion of the fastening member head protrudes more than the rear surface of the non-orbiting scroll to be inserted into the fastening member accommodating groove of the back pressure chamber assembly.

* * * * *